US008234897B2

(12) United States Patent
Kuwayama et al.

(10) Patent No.: US 8,234,897 B2
(45) Date of Patent: Aug. 7, 2012

(54) PRESS-FORMING DEVICE AND PRESS-FORMING METHOD

(75) Inventors: Takuya Kuwayama, Chiba (JP); Noriyuki Suzuki, Chiba (JP); Patrick Duroux, Compiegne (FR)

(73) Assignees: Nippon Steel Corporation, Toyko (JP); Arcelor France, St Denis (FR)

( * ) Notice: Subject to any disclaimer, the term of this patent is extended or adjusted under 35 U.S.C. 154(b) by 928 days.

(21) Appl. No.: 12/087,657

(22) PCT Filed: Jan. 12, 2007

(86) PCT No.: PCT/JP2007/050350

§ 371 (c)(1),
(2), (4) Date: Jul. 11, 2008

(87) PCT Pub. No.: WO2007/080983

PCT Pub. Date: Jul. 19, 2007

(65) Prior Publication Data

US 2009/0120151 A1 May 14, 2009

(30) Foreign Application Priority Data

Jan. 13, 2006 (JP) ..... 2006-006370

(51) Int. Cl.
*B21C 51/00* (2006.01)
*B21D 55/00* (2006.01)

(52) U.S. Cl. ..... 72/21.4; 72/20.3; 72/20.4; 72/31.11

(58) Field of Classification Search ..... 72/20.1, 72/20.2, 21.1, 21.4, 31.11, 347, 441, 20.3, 72/20.4; 700/206
See application file for complete search history.

(56) References Cited

U.S. PATENT DOCUMENTS

| | | | | |
|---|---|---|---|---|
| 4,723,429 | A * | 2/1988 | Weber et al. | 72/21.4 |
| 4,779,442 | A * | 10/1988 | Welsh | 72/347 |
| 5,142,769 | A * | 9/1992 | Gold et al. | 29/621.1 |
| 5,941,111 | A * | 8/1999 | Skala et al. | 72/21.4 |
| 6,101,857 | A * | 8/2000 | Fox et al. | 72/15.1 |
| 6,871,521 | B2 * | 3/2005 | Sperrer | 72/21.1 |
| 7,130,714 | B1 * | 10/2006 | Kulkarni et al. | 700/165 |
| 7,216,519 | B1 * | 5/2007 | Ngo et al. | 72/21.4 |
| 7,331,205 | B2 * | 2/2008 | Chitty et al. | 72/21.1 |

FOREIGN PATENT DOCUMENTS

| | | |
|---|---|---|
| JP | 5-337554 A | 12/1993 |
| JP | 9-29358 A | 2/1997 |

(Continued)

*Primary Examiner* — Edward Tolan
(74) *Attorney, Agent, or Firm* — Birch, Stewart, Kolasch & Birch, LLP

(57) ABSTRACT

A press-forming device has a punch (2), a die (7) which relatively moves with respect to the punch (2), a strain amount measuring means (8) which is provided inside a member to be controlled and measures a strain amount of the aforesaid member to be controlled which occurs in accordance with press-forming, when at least one of the punch (2) and the die (7) is made the aforesaid member to be controlled, and a strain amount control means (9) which is provided in the aforesaid member to be controlled and controls the strain amount of the aforesaid member to be controlled which occurs in accordance with press-forming. The strain amount control means (9) controls a drive amount of the aforesaid member to be controlled so that the strain amount measured by the strain amount measuring means (8) is in a predetermined range during forming. Thereby, reduction in a surface strain, improvement in shape fixability or the like of a press formed product can be achieved.

16 Claims, 16 Drawing Sheets

FOREIGN PATENT DOCUMENTS

| | | | |
|---|---|---|---|
| JP | 2003-154413 | A | 5/2003 |
| JP | 2004-249365 | A | 9/2004 |
| JP | 2005-161399 | A | 6/2005 |
| JP | 2005-186154 | A | 7/2005 |
| JP | 2005-199336 | A | 7/2005 |
| JP | 2005-211944 | A | 8/2005 |
| JP | 2005-288533 | A | 10/2005 |

* cited by examiner

PRESS-FORMING DEVICE AND PRESS-FORMING METHOD

TECHNICAL FIELD

The present invention relates to a press-forming device and a press-forming method of, for example, a thin plate, and particularly relates to a press-forming device and a press-forming method which measure a strain of a tool occurring at the time of press working.

BACKGROUND ART

At the time of press working, a stamping force by a press machine, a reaction force of the material to be worked deformation reaction and the like act on a tool and the tool elastically deforms. Such elastic deformation is called a strain of the tool.

FIG. 25 shows a conceptual view of the tool strain occurring at the time of press-forming in a press machine constituted of a punch 2, a die 7 and a blank holder 4. The solid line shows the outer shape of the tool before press-forming, and the dotted line shows the outer shape of the tool when the tool elastically deforms at the time of press-forming. FIG. 25 shows the deformation with emphasis, but the elastic deformation amount in the load range of actual forming is in the order of about several micrometers.

FIG. 25 shows only the deformation of the punch 2, the die 7 and the blank holder 4, but to be exact, it is conceivable that the elastic deformation also occurs to the other press mechanism elements such as a press machine slider, and a guide pin. However, the dominant elastic deformation in a press forming phenomenon is considered to be the deformation of the punch, die and blank holder, and the elastic deformation relating to three of the punch, die and blank holder will be discussed as the strain of the tool hereinafter.

Occurrence of a tool strain reduces the dimensional accuracy of a formed product. The deformation amount and deformation distribution of the formed product due to a tool strain change in accordance with the stamping force by the press machine, reaction force by the material to be worked deformation resistance and the like. Therefore, the tool strain changes due to change of the various conditions such as the press machine, tool shape, quality of the material to be worked, shape of the material to be worked, lubrication and stamping force, and the change of the tool strain causes quality scatter between the stamp parts. In the forming prediction by the finite element method or the like cannot take the tool strain into consideration due to the calculation ability and the like, and therefore, the tool strain makes the prediction of forming by the finite element method difficult.

As the device for controlling a tool strain, Patent Document 1 discloses a device for correcting half-releasing for a press brake in a press brake which bends a workpiece between a punch and a die by operating the punch mounted to an upper beam and the die mounted to a lower beam to contact and separate from each other, and the device including a plurality of strain sensors for the upper beam which are provided along the longitudinal direction of the above described upper beam and detects only the strain of the above described upper beam, a plurality of strain sensors for the lower beam which are provided along the longitudinal direction of the above described lower beam and detects the strain of the above described lower beam, a plurality of actuators which are disposed to spread between the above described lower beam and the lower tool, or between the above described upper beam and the upper tool, along the direction of the bending line, and apply stamping force in the vertical direction to the above described lower tool or upper tool, and a control means that stops descend of the above described upper beam partway before completion of pressing after start of the pressing, fetches detection outputs of the above described strain sensor for the upper beam and the above described strain sensor for the lower beam at the time of stopping state, calculates strain amounts of the upper beam and the lower beam based on the respective detection outputs, controls drive of the above described plurality of actuators so that the strain amounts of the upper beam and the lower beam become the proper values based on the calculated values, and thereafter conducts control of restarting pressing control. Thereby, the formed product having a uniform bending angle over the entire length is to be obtained.

Patent Document 2 discloses a press tool in a tool press forming characterized by including a load detection means, a stroke detection means, a detection means of press frequency, detection means of tool temperature, a deformation prediction model constituted of a single model or a plurality models of an abrasion model of the tool, a thermal deformation model of the tool, a load deformation model of the tool, a thermal deformation model of a material to be worked and a spring back model of the material to be worked, a multivariable control signal generator and a drive device which deforms the internal wall of forming recessed part. Thereby, the product having dimension and shape with high accuracy is to be obtained.

Patent Document 3 discloses a press-forming device which does not control a tool strain, but is characterized by having a punch, a die and a blank holder, an abrasion force measuring means mounted between the above described die and the above described blank holder, and a blank holding force regulating means. Thereby, a proper frictional force can be applied without recourse to the variation factor such as lubricity between the tool and the workpiece and surface property, and a favorable formed product is to be always provided regardless of the variation of the material characteristics and environmental change.

Patent Document 1 discloses the invention relating to the device having the function of measuring a tool strain, but it does not disclose the invention except that the strain sensor for the beam is provided along the longitudinal direction of the beam for the press brake. Therefore, in order to conduct quality control with high accuracy in press-forming using a tool having a shape more complicated than the beam for press brake, the invention of Patent Document 1 cannot sufficiently measure a tool strain occurring in the tool having the complicated shape, and the invention of Patent Document 1 is not sufficient.

Further, Patent Document 1 discloses the invention relating to a device controlling a tool strain, but while the strain detection parts used for detection of a strain of the upper and lower beams for the press brake are installed at the upper and lower beams, the actuator used for strain control of the upper and lower beams is installed between the lower beam and the lower tool, or between the upper beam and the upper tool, and the strain detection position and the strain control position differ.

Accordingly, when the invention of Patent Document 1 is applied to the tool having the shape more complicated than a tool for a press brake, such as a draw forming tool, strain control by the actuator exerts an influence on not only the strain amount at the strain amount detection position which is desired to be controlled, but also on the strain amount at the strain amount detection position which is not desired to be controlled, and therefore, the S/N ratio as control becomes low. Further, in forming with the tool having a complicated shape, the contact pressure distribution acting on the tool is not uniform, and the strain amount distribution occurring to the tool is complicated. Accordingly, the desired strain control amount differs according to the strain amount detection position. Therefore, in the constitution of the invention of Patent Document 1, the actuator control for controlling the strain control amount to the desired amount is difficult.

Further, in the invention of Patent Document 1, forming is temporarily stopped during forming, the strain amounts of the upper and lower beams are detected in the stopping state, the control by the actuator is conducted so that the strain amounts of the upper and lower beams become proper values, and thereafter, forming is restarted. However, unlike forming mainly constituted of bending as the press brake, in draw forming, the frictional force between the material to be worked and the tool significantly differs from the frictional force during forming when forming is intermitted halfway. Therefore, when the invention of Patent Document 1 is applied to draw forming, the measured tool strain amount differs from the tool strain amount during forming, and control accuracy becomes worse.

Further, in the invention of Patent Document 1, working has to be temporarily stopped during forming, and the cycling time of forming becomes worse by carrying out the control according to the invention of Patent Document 1.

Patent Document 2 discloses the invention relating to the device controlling a tool strain. The invention uses the deformation prediction model which predicts the deformation states of the tool and the material to be worked based on the reduction in thickness detected by the stroke detection means, the load detected by the load detecting means and the temperature detected by the detecting means of the tool temperature, and estimates the correction amount of the forming recessed part shape required for obtaining the product of a predetermined dimension and shape from the prediction result to perform control. The deformation state of the tool is the prediction using the model, and is not directly measured.

Patent Document 3 discloses the following invention as the principle of directly measuring the frictional force. Namely, the flat plate and the blank holder are fastened with a bolt or the like to sandwich a strain measuring element, and when a workpiece is sandwiched by the die and the above described flat plate and slid in this state, a shearing strain occurs to the above described strain measuring element and the frictional force can be measured. This intends to measure the frictional force by installing some structure in the blank holder or the die, but does not directly measure the tool strain of the blank holder or the die.

In order to conduct quality control with high accuracy, it is indispensable to measure the tool strains of the punch, die and blank holder directly, and for this purpose, the inventions of Patent Documents 1 to 3 are insufficient.

Thus, the present invention has an object to provide a press-forming device and a press-forming method which is capable of controlling a tool strain during press work and has high accuracy and high applicability. The present invention particularly relates to a press-forming device and a press-forming method which measure a tool strain occurring during press work.

[Patent Document 1] Japanese Patent Application Laid-open No. Hei 5-337554

[Patent Document 2] Japanese Patent Application Laid-open No. Hei 9-29358

[Patent Document 3] Japanese Patent Application Laid-open No. 2004-249365

SUMMARY OF THE INVENTION

The means of the present invention are as follows.

(1) A press-forming device characterized by having a punch, a die which relatively moves with respect to the aforesaid punch, and a strain amount measuring unit which is provided inside a member to be controlled, and measures a strain amount of the aforesaid member to be controlled which occurs in accordance with press-forming, when at least any one of the aforesaid punch and the aforesaid die is made the aforesaid member to be controlled.

(2) A press-forming device characterized by having a punch, a die which relatively moves with respect to the aforesaid punch, a blank holder which applies a blank holding force to a material to be worked, and a strain amount measuring unit which is provided inside a member to be controlled, and measures a strain amount of the aforesaid member to be controlled which occurs in accordance with press-forming, when at least any one of the aforesaid punch, the aforesaid die and the aforesaid blank holder is made as the aforesaid member to be controlled.

(3) The press-forming device according to (1) or (2) characterized by having a strain amount controller which is provided in the aforesaid member to be controlled and controls a strain amount of the aforesaid member to be controlled which occurs in accordance with press-forming.

(4) The press-forming device according to (3) characterized in that the aforesaid strain amount controller controls a drive amount of the aforesaid member to be controlled so that the strain amount measured by the aforesaid strain amount measuring unit is in a predetermined range during forming.

(5) The press-forming device according to any one of (1) to (4) characterized by having a frictional force calculator which calculates a frictional force which occurs at a time of sliding of the aforesaid member to be controlled and the aforesaid material to be worked based on the strain amount measured by the aforesaid strain amount measuring unit.

(6) The press-forming device according to (5) characterized by having a first spring back amount calculator which calculates a spring back amount of a formed product shape based on the frictional force calculated by the aforesaid frictional force calculator.

(7) The press-forming device according to any one of (1) to (4) characterized by having a second spring back amount calculator which calculates a spring back amount of a formed product shape based on the strain amount measured by the aforesaid strain amount measuring unit.

(8) The press-forming device according to any one of (1) to (7) characterized in that the aforesaid strain amount measuring unit is a piezoelectric sensor.

(9) The press-forming device according to (3) or (4) characterized in that the aforesaid strain amount controller is a piezoelectric actuator.

(10) A press-forming method using the press-forming device according to (3) characterized in that a drive amount of the aforesaid member to be controlled by the aforesaid strain amount controller is controlled so that the strain amount measured by the aforesaid strain amount measuring unit is in a predetermined range during forming.

According to the present invention constituted as described above, the press-forming device and the press-forming method which are capable of controlling a tool strain at the time of press-forming and have high accuracy and high applicability can be provided.

DETAILED DESCRIPTION OF THE PREFERRED EMBODIMENTS

A best mode for carrying out the present invention will now be described in detail by using the drawings.

First Embodiment

Figure 1:
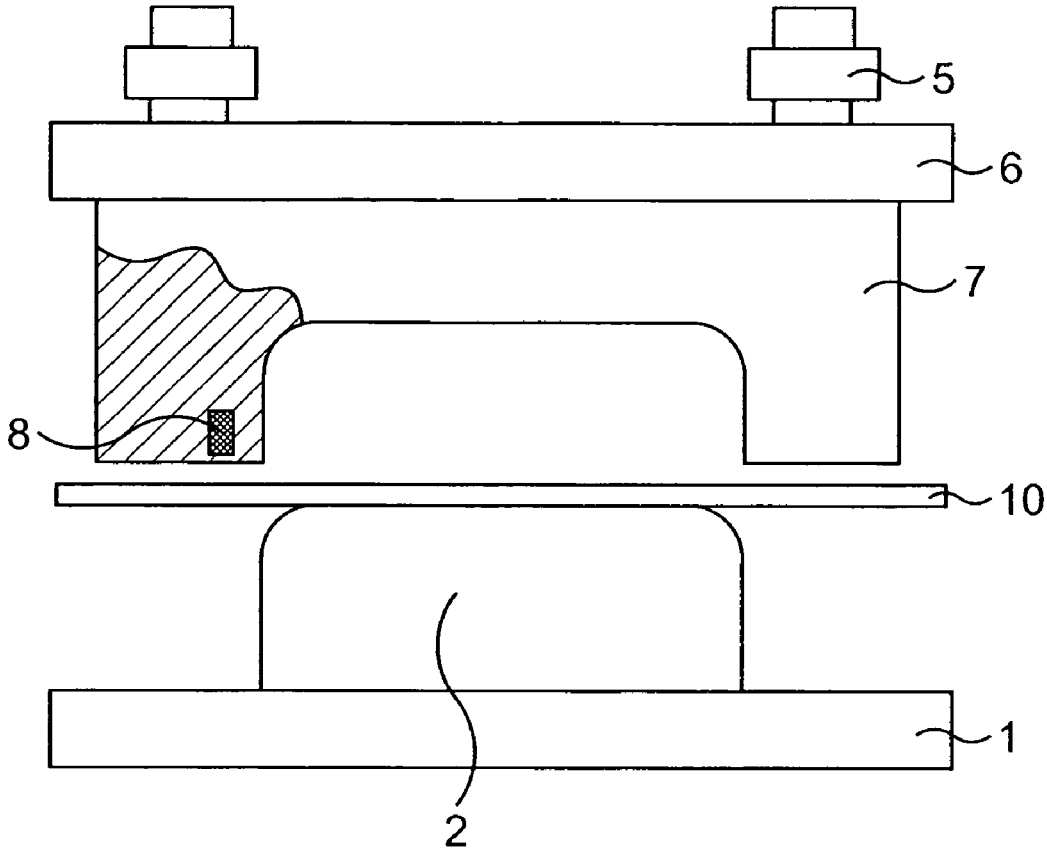
FIG. 1 is a schematic view of a press-forming device having a strain amount measuring means.

FIG. 1 shows a schematic view of an example of a press-forming device of a first embodiment. A punch 2 is mounted on a press machine bolster 1, and a die 7 is mounted to an upper slide 6 which is driven by a forming load/speed regulating means 5 respectively. Reference numeral 10 in the drawing denotes a thin plate that is a material to be worked.

In FIG. 1, the die 7 is selected as a member to be controlled, and a strain amount measuring means 8 is installed in it.

Figure 2A:
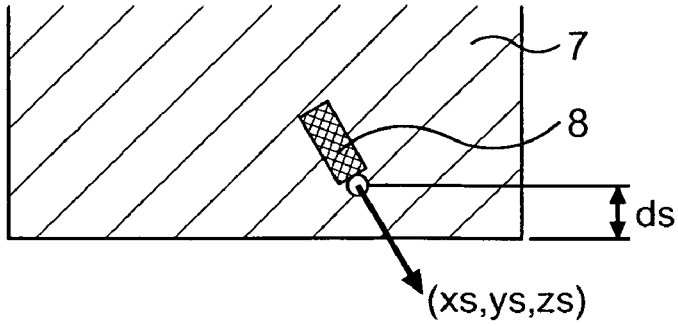
FIG. 2A is a detail view of an installation situation of the strain amount measuring means.
Figure 2B:
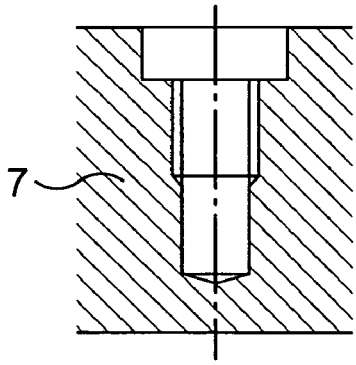
FIG. 2B is a sectional view of a die.
Figure 2C:
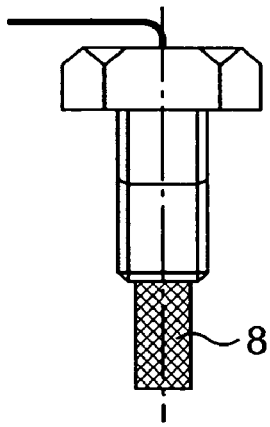
FIG. 2C is a side view of the strain amount measuring means and a plug.

FIG. 2A shows an enlarged area in the vicinity of the installation location of the strain amount measuring means 8. As one example of the installation method of the strain amount measuring means 8, a drill hole which does not penetrate through the die 7 is bored in the die 7 and a female thread screw is cut in the hole as shown in a schematic view of FIG. 2B, the strain measuring means 8 shown in FIG. 2C is placed in the bottom of the drill hole, and an axial force is applied with a plug to press-fit it therein. In the case where the strain amount measuring means 8 is diagonally installed as shown in FIG. 2A, or the like, there is the method for charging the air space to make the surface uniform as necessary.

The strain amount measuring means 8 is installed inside the member to be controlled so that the strain amount measuring position is at ds [mm] from the tool surface. ds [mm] is desirably in the range of 1 to 500 [mm].

The strain amount measuring means 8 is installed inside the member to be controlled so that the strain amount measuring direction is expressed by the vector having the components of (xs, ys, zs) in an arbitrary orthogonal coordinate system with the strain amount measuring position as an origin. In this case, xs, ys and zs are respectively in the range of −1 to 1, and are expressed by the following mathematical expression (1).

[Mathematical Expression 1]

$$\sqrt{xs^2+ys^2+zs^2}=1 \quad (1)$$

Figure 3:
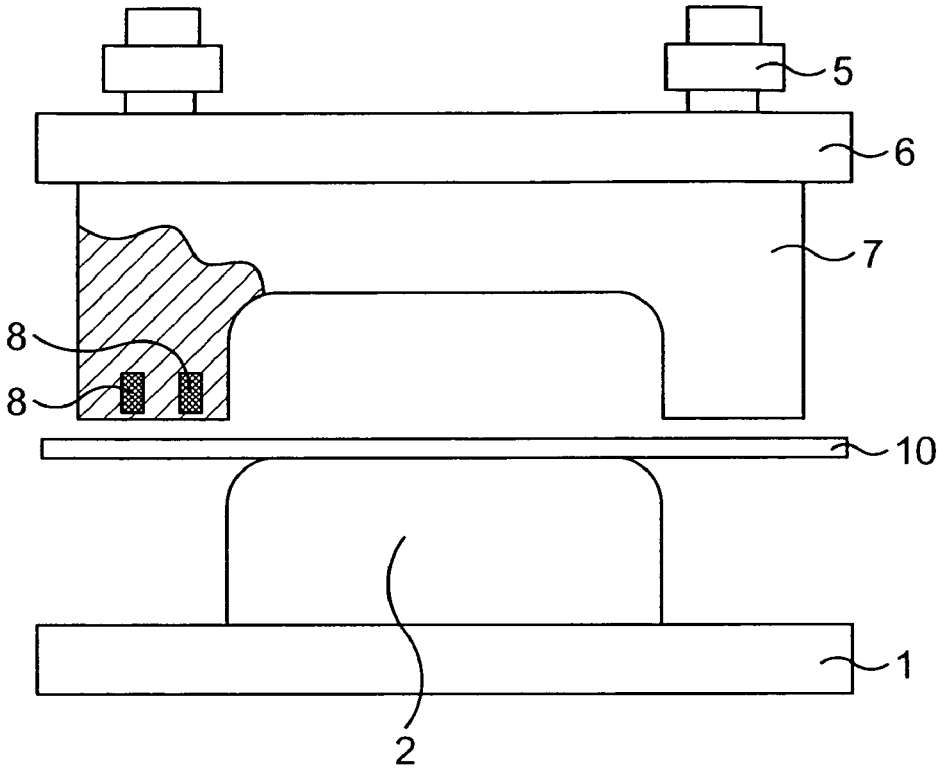
FIG. 3 is a schematic view of a press-forming device having a plurality of strain amount measuring means.

FIG. 1 shows the case where one strain amount measuring means 8 is installed in the member to be controlled, but a plurality of strain amount measuring means 8 may be installed in the member to be controlled. FIG. 3 shows an example in which a plurality of strain amount measuring means 8 are installed. FIG. 3 is the same as FIG. 2 except that two strain amount measuring means 8 are installed in the member to be controlled.

Figure 4:
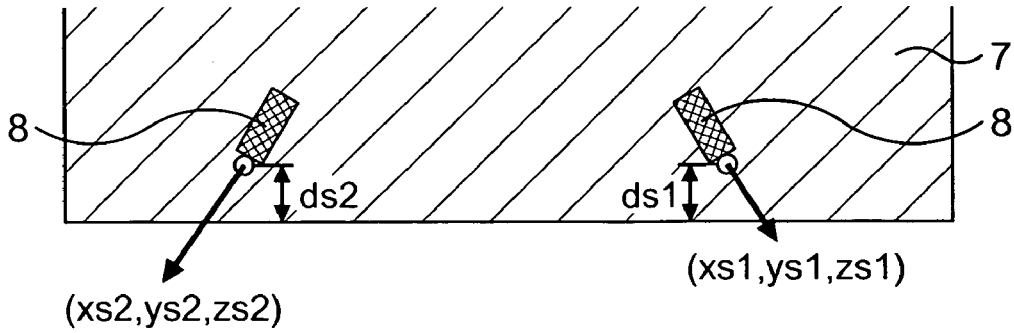
FIG. 4 is a detail view of an installation situation of the strain amount measuring means in FIG. 3.

FIG. 4 shows an enlarged area in the vicinity of the installation location of the strain amount measuring means 8 in FIG. 3. The strain amount measuring positions and the strain amount measuring direction of a plurality of strain amount measuring means 8 can be independently determined respectively.

Figure 5:
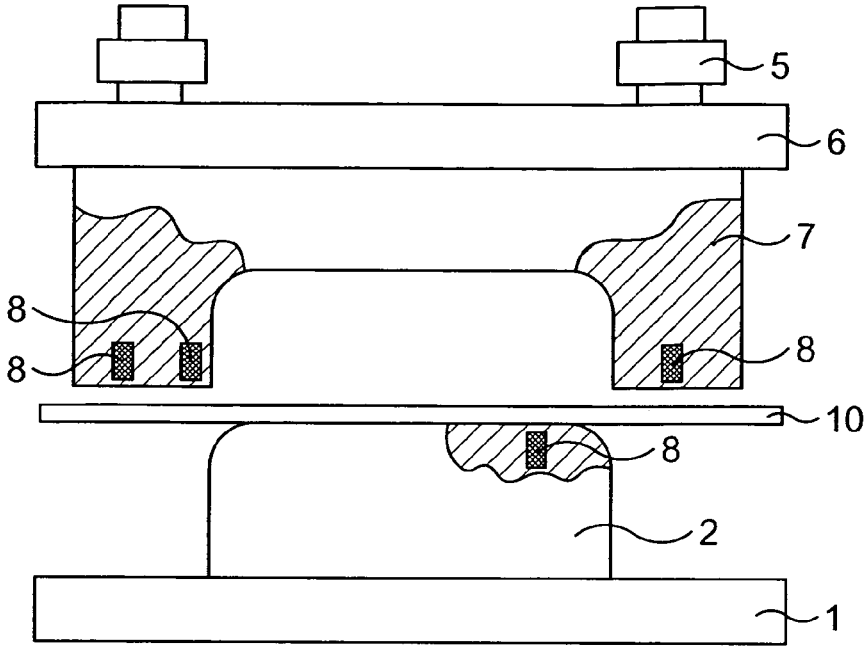
FIG. 5 is a schematic view of the press-forming device having two of the die and punch as objects to be controlled and having the strain amount measuring means in the objects to be controlled.

In FIG. 1, the die 7 is selected as the member to be controlled, but at least any one of the die 7 and the punch 2 needs to be selected as the member to be controlled. FIG. 5 shows the case where both the die 7 and the punch 2 are selected as the member to be controlled.

Second Embodiment

Figure 6:
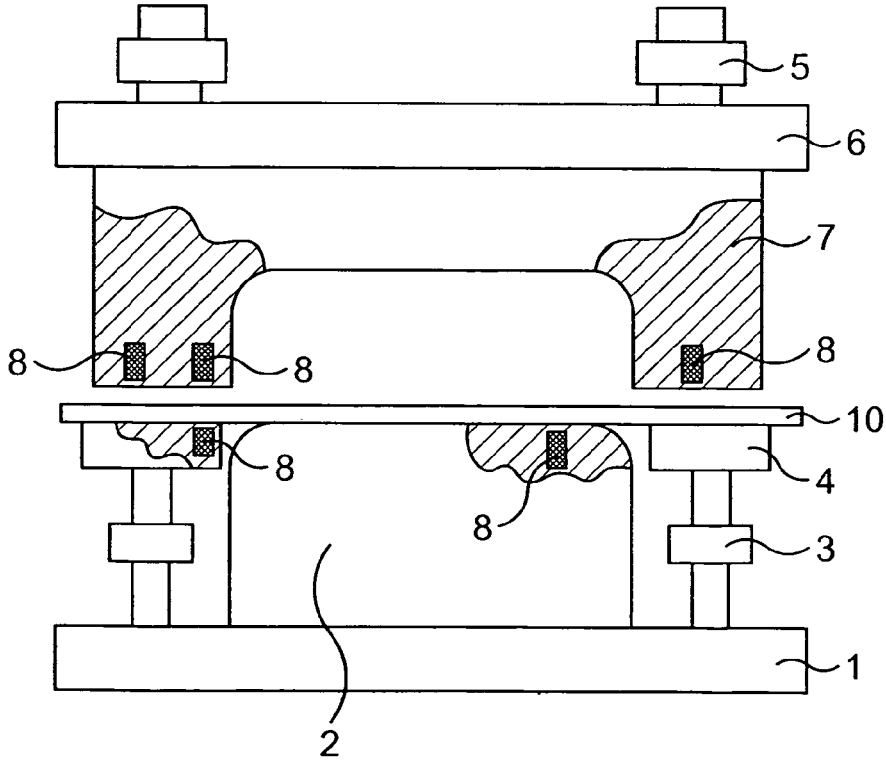
FIG. 6 is a schematic view of the press-forming device having three of the die, punch and blank holder as objects to be controlled, and having the strain amount measuring means in the objects to be controlled.

FIG. 6 shows a schematic view of an example of a press-forming device of a second embodiment. The punch 2 is mounted on the press machine bolster 1, the blank holder 4 is mounted to the blank holding force regulating means 3, and the die 7 is mounted to the upper slide 6 which is driven by the tool load/speed regulating means 5.

In FIG. 6, three of the die 7, the punch 2 and the blank holder 4 are selected as the members to be controlled, and the strain amount measuring means 8 are installed in their respective inner parts. At least any one of the die 7, the punch 2 and the blank holder 4 needs to be selected as the member to be controlled.

Third Embodiment

Figure 7:
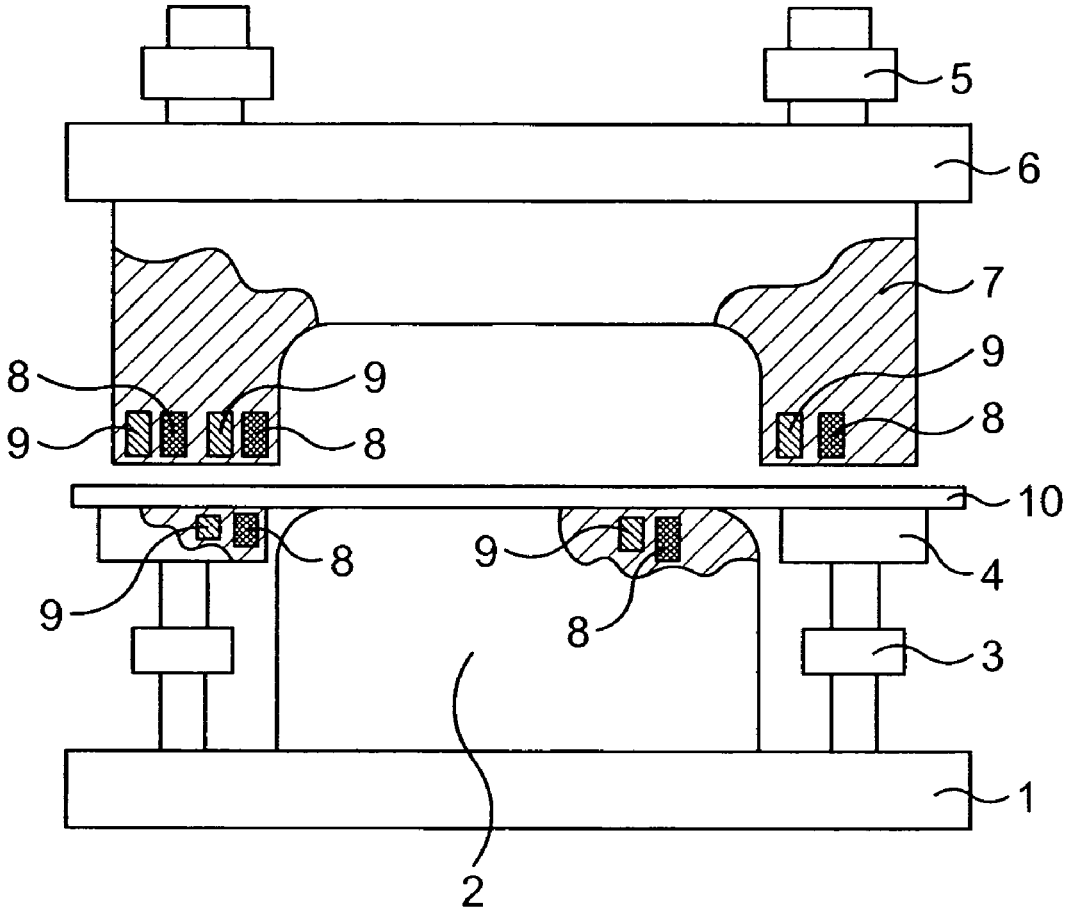
FIG. 7 is a schematic view of the press-forming device having the strain amount measuring means and a strain amount control means.

FIG. 7 shows a schematic view of an example of a press-forming device of a third embodiment. As in FIG. 6, the punch 2 is mounted on the press machine bolster 1, the blank holder 4 is mounted to the blank holding force regulating means 3, and the die 7 is mounted to the upper slide 6 which is driven by the tool load/speed regulating means 5.

In FIG. 7, three of the die 7, the punch 2 and the blank holder 4 are selected as the members to be controlled, and the strain amount measuring means 8 and strain amount control means 9 are installed in their respective inner parts.

Figure 8:
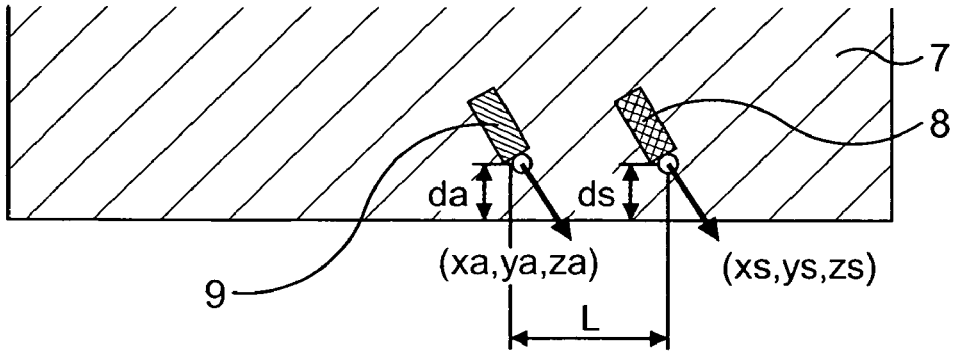
FIG. 8 is a detail view of the installation situation of the strain amount measuring means and the strain amount control means in FIG. 7.

FIG. 8 shows the details of the installation situation of the strain amount measuring means 8 and the strain amount control means 9 in FIG. 7. The installation method of the strain amount measuring means 8 is the same as described with FIGS. 2A to 2C. As the installation method of the strain amount control means 9, there is also a method for boring a drill hole which does not penetrate through and press-fitting the strain amount control means 9 by a plug as described with FIGS. 2A to 2C, as one example.

The strain amount control means 9 is installed inside the member to be controlled so that the strain amount control position is at da [mm] from the tool surface. da [mm] is desirably in the range of 1 to 500 [mm].

Further, the strain amount control means 9 is installed inside the member to be controlled so that the strain amount control direction is expressed by the vector with its components being (xa, ya, za) in an arbitrary orthogonal coordinate system with the strain amount control position as the origin. In this case, xa, ya and za are respectively in the range of −1 to 1, and are expressed by the following mathematical expression (2).

[Mathematical Expression 2]

$$\sqrt{xa^2+ya^2+za^2}=1 \tag{2}$$

When the strain amount measured by the strain amount measuring means 8 is desired to be controlled by the strain amount control means 9, the strain amount control means 9 is installed so that the distance between the measurement position of the strain amount desired to be controlled and the strain amount control position of the strain amount control means 9 is L [mm]. L [mm] is desirably in the range of 1 to 1000 [mm].

As an example of the control method, there is the method for controlling the drive amount of the member to be controlled by the strain amount control means 9 so that the strain amount measured by the strain amount measuring means 8 is in a predetermined range during forming. As one concrete example, when the compression strain amount measured by the strain amount measuring means 8 during forming exceeds 110με, control is conducted so as to generate a strain in the direction to cancel off the compression strain amount by the strain amount control means 9 so that the compression strain amount measured by the strain amount measuring means 8 becomes 110με or less.

Fourth Embodiment

Figure 9:
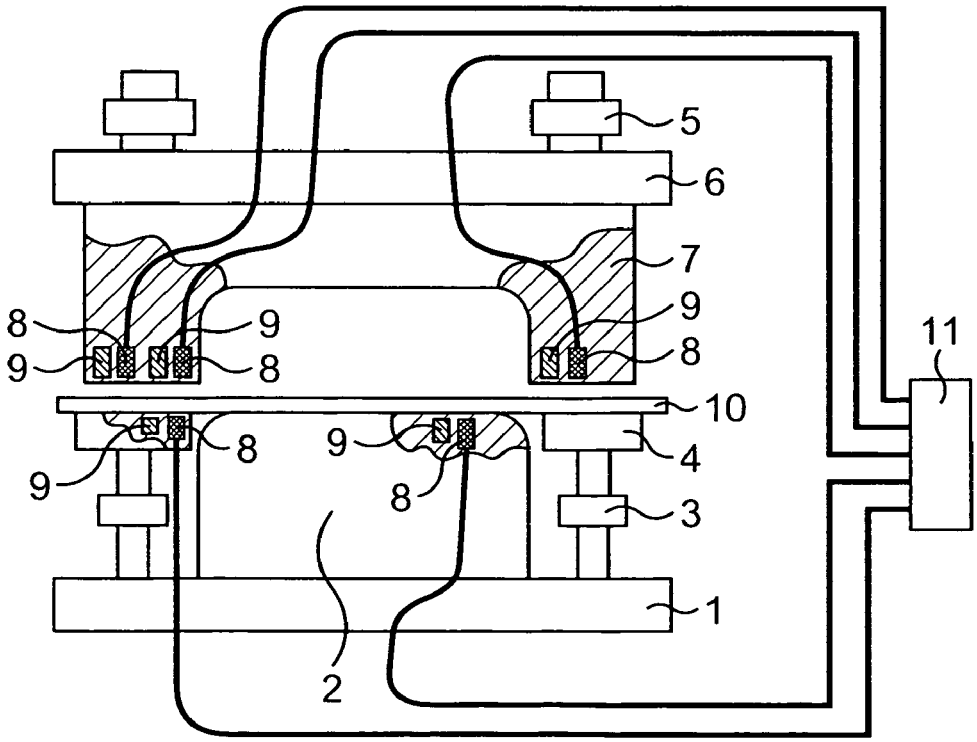
FIG. 9 is a schematic view of the press-forming device having the strain amount measuring means, the strain amount control means and a frictional force calculating means.

FIG. 9 shows a schematic view of a press-forming device of a fourth embodiment. In this case, the output of the strain amount measuring means 8 installed as in the press-forming device shown in FIG. 7 is adapted to be inputted in a frictional force calculating means 11. The frictional force calculating means 11 calculates the frictional force occurring at the time of sliding of the member to be controlled and the material to be worked based on the strain amount measured by the strain amount measuring means 8.

Figure 10:
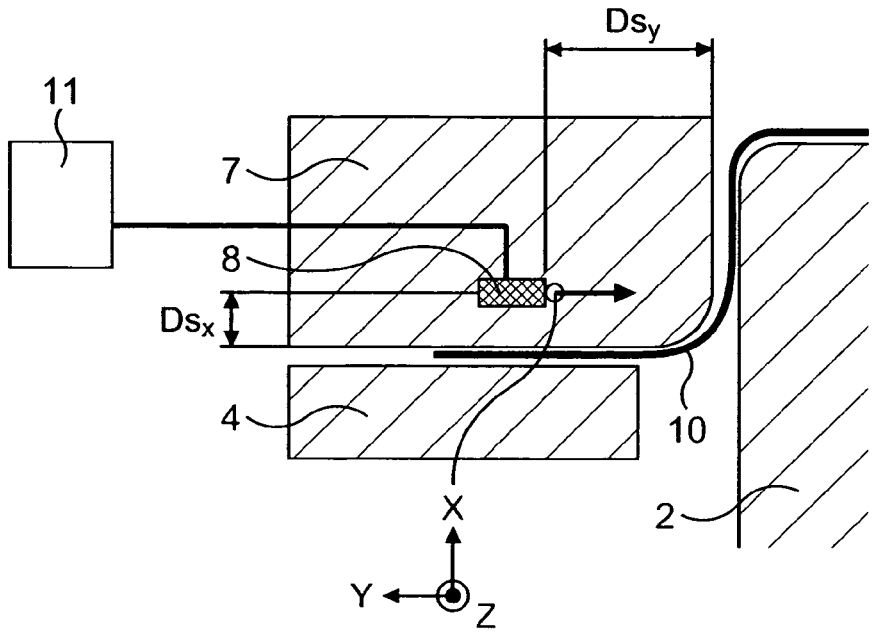
FIG. 10 is a view showing an arrangement example of the strain amount measuring means in FIG. 9.
Figure 11:
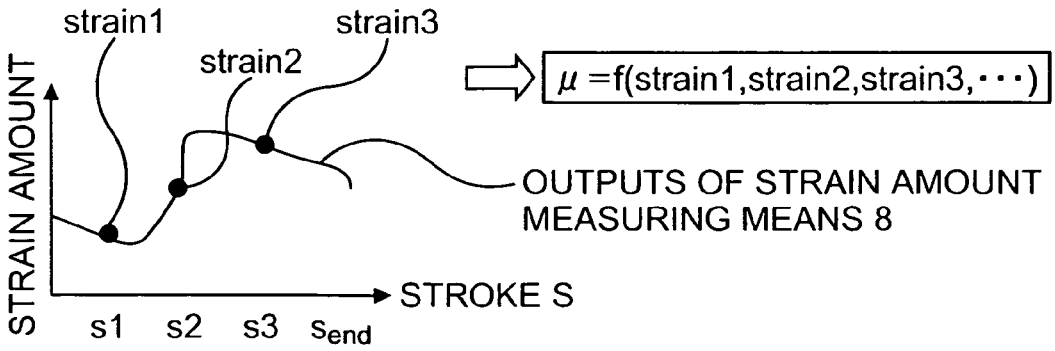
FIG. 11 is a diagram for explaining one example of the calculation processing by the frictional force calculating means.

The frictional force calculating means 11 will be described in more detail by using FIGS. 10 and 11. In FIG. 10, the strain amount measuring means 8 is installed inside the die 7 so that a distance $Ds_x$ from the holder surface satisfies $Ds_x$=10 mm, and the distance $Ds_y$ from the die vertical wall satisfies $Ds_y$=15 mm.

The strain amount measuring means 8 is installed inside the die 7 so that the strain amount measuring direction is expressed by the vector with the components satisfying (xs, ys, zs)=(0, 1, 0) in the orthogonal coordinate system as shown in the drawing with the formed product height direction set as X, the formed product width direction set as Y and the formed product longitudinal direction set as Z with the strain amount measuring position as the origin. Namely, the strain amount measuring means 8 can detect the compression and the stretching strain in the Y direction in the drawing.

When the material 10 to be worked is formed in this state, the material 10 to be worked winds on a shoulder R portion of the die 7 with the progress of forming, and causes a compression strain to the shoulder R portion of the die 7. The compression strain of the shoulder R portion of the die 7 is measured by the strain amount measuring means 8, and is transmitted to the frictional force calculating means 11.

The function of the frictional force calculating means 11 will be described by using FIG. 11. Since the output from the strain amount measuring means 8 changes in value in accordance with forming strokes as shown in FIG. 11, the frictional force occurring at the time of sliding of the die 7 and the material 10 to be worked is calculated by extracting the strain amount at a stroke position S1 as Strain 1, and the strain amount at a stroke position S2 as Strain 2, . . . and substituting these values into the conversion formula. As the conversion formula, the method of using FEM analysis and obtaining correlation of the frictional coefficient set value in the FEM analysis and the strain amount occurring to the tool as a result of the analysis by polynomial approximation is preferably adopted. As one concrete example, estimation is performed by the following formula.

$$F_{fric}=(3\times10^{-3})\times\text{Strain }(s)\times\text{BHF}$$

$F_{fric}$: frictional force [N] occurring at the time of sliding

Strain (s): strain amount at the stroke position S=dr+dp+r (dr: die shoulder R, dp: punch shoulder R, t: material to be worked plate thickness)

BHF: blank holding force [N]

Fifth Embodiment

Figure 12:
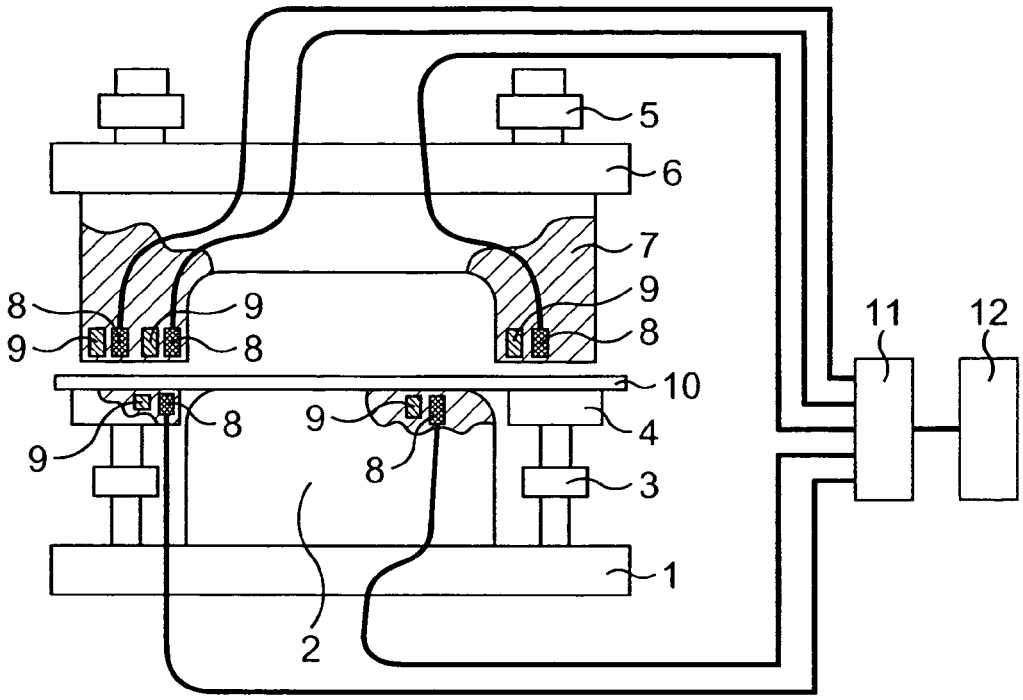
FIG. 12 is a schematic view of the press-forming device having the strain amount measuring means, the strain amount control means, the frictional force calculating means and a first spring back amount calculating means.

FIG. 12 shows a schematic view of a press-forming device of a fifth embodiment. In this case, the press-forming device is adapted so that the output of the strain amount measuring means 8 installed as in the press-forming device shown in FIG. 7 is inputted into the frictional force calculating means 11, and the frictional force which is the output of the frictional force calculating means 11 is transmitted to a first spring back amount calculating means 12. The frictional force calculating means 11 calculates the frictional force occurring at the time of sliding of the member to be controlled and the material to be worked based on the strain amount measured in the strain amount measuring means 8, and is the same as in the fourth embodiment.

About the function of the first spring back amount calculating means 12, the first spring back amount calculating means 12 calculates the spring back amount of the press formed product by substituting the frictional force which is the output of the frictional force calculating means 11 into the conversion formula. As the conversion formula, the method for obtaining the spring back amount by performing press-forming a plurality of times, studying the correlation of the output of the frictional force calculating means 11 and the formed product shape, and making approximation by using a polynomial expression or the like is preferably adopted. As one concrete example, estimation is performed by the following formula.

$$\Delta\theta_p=0.13F_{fric}-4.5$$

$\Delta\theta_p$: spring back amount of formed product punch shoulder angle [deg]

$F_{fric}$: frictional force [N] occurring at the time of sliding

Sixth Embodiment

Figure 13:
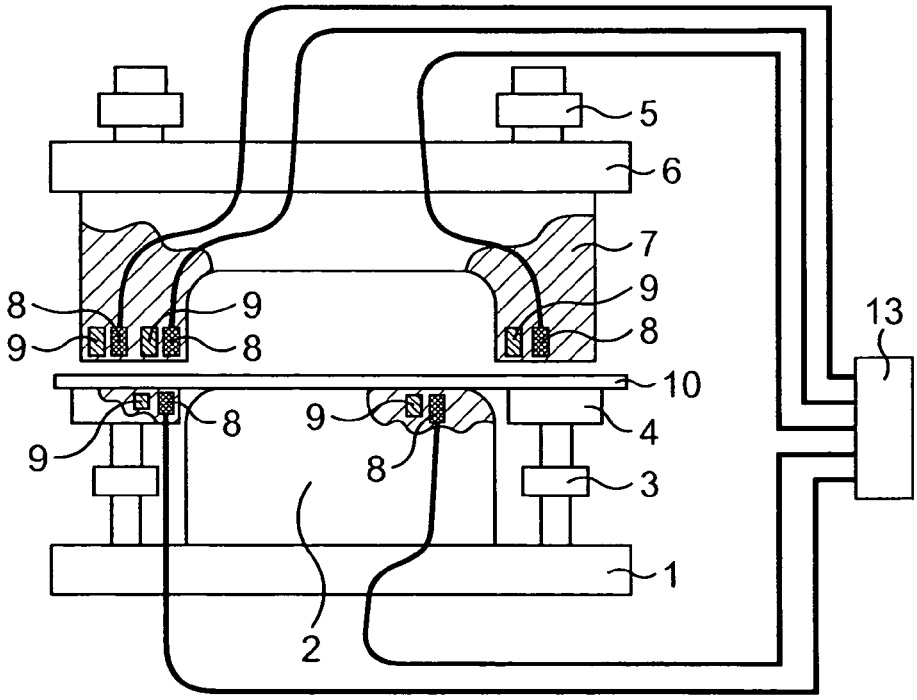
FIG. 13 is a schematic view of the press-forming device having the strain amount measuring means, the strain amount control means and a second spring back amount calculating means.

FIG. 13 shows a schematic view of a press-forming device of a sixth embodiment. In this case, the press-forming device is adapted so that the output of the strain amount measuring means 8 installed as in the press-forming device shown in FIG. 7 is transmitted to a second spring back amount calculating means 13. The second spring back amount calculating means 13 calculates the spring back amount of the press-formed product by substituting the strain amount measured with the strain amount measuring means 8 into the conversion formula. As the conversion formula, the method for obtaining the spring back amount by performing press-forming a plurality of times, studying the correlation of the output of the strain amount measuring means 8 and the formed product shape, and making approximation by using a polynomial expression or the like is preferably adopted. As one concrete example, estimation is performed by the following formula.

$$\Delta\theta_p=0.15\ \text{Strain}\ (s)-4.5$$

$\Delta\theta_p$: spring back amount of formed product punch shoulder angle [deg]

Strain (s): strain amount at stroke position S=dr+dp+t (dr: die shoulder R, dp: punch shoulder R, t: material to be worked plate thickness)

As the strain amount measuring means 8, by using a piezoelectric sensor or a strain gauge, the strain amount can be easily measured. As the strain amount control means 9, by using a piezoelectric actuator, the strain amount can be easily controlled.

Ninth Embodiment

Figure 14:
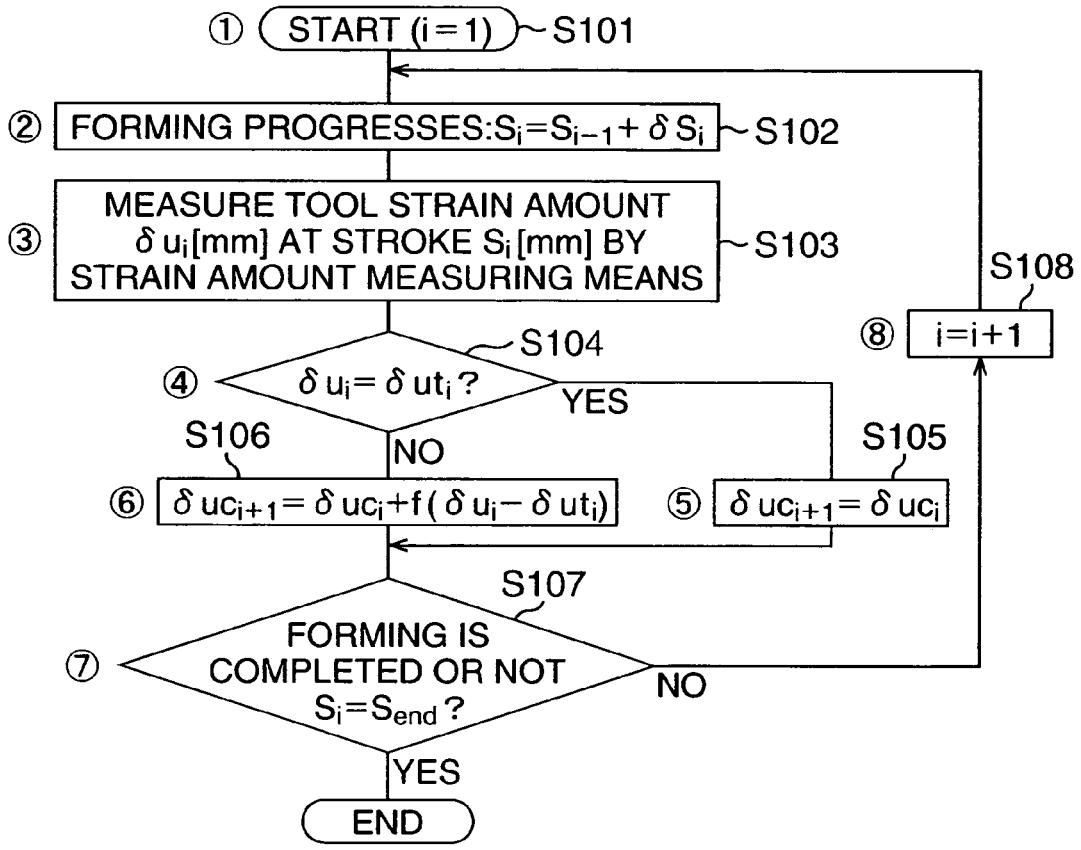
FIG. 14 is a flow chart for explaining the operation procedure of the press-forming device of the present invention which controls the strain amount.

As a ninth embodiment, a method for controlling a drive amount of the member to be controlled by the strain amount control means 9 so that the strain amount measured by the strain amount measuring means 8 is in the predetermined range during forming will be described by using a flow chart shown in FIG. 14.

First, in step S101, the material to be worked is set in the press machine, and forming is started. At this time, i=1. Next, in step S102, a press machine stroke $S_{i-1}$ [mm] is advanced by $\delta S_i$ [mm] to make the press machine stroke $S_i$ [mm]. When i=1, for example, $S_1=S_0+\delta S_1$, and since $S_0=0$, $S_1=\delta S_1$. $\delta S_i$ [mm] is determined before working.

In step S103, a tool strain amount $\delta u_i$ [mm] at the stroke $S_i$ [mm] is measured by the strain amount measuring means 8. In step S104, the tool strain amount $\delta u_i$ [mm] measured in step S103 and a tool strain amount target value $\delta ut_i$ [mm] are compared. $\delta ut_i$ [mm] is determined before working.

If $\delta u_i=\delta ut_i$, the flow goes to step S105, and without conducting control, the flow goes to step S107. If $\delta u_i\neq\delta ut_i$, the flow goes to step S106, and by using the strain amount control means 9, the tool strain control amount $\delta uc_{i+1}$ [mm] is increased and decreased in accordance with the difference $\delta u_i-\delta ut_i$ between the tool strain amount and the tool strain amount target value.

In step S107, the stroke $S_i$ [mm] and the forming completion stroke $S_{end}$ [mm] are compared. If $S_i=S_{end}$, forming is completed. In step S107, if $S_i\neq S_{end}$, the flow goes to step S108, i is increased by 1, and the flow returns to step S102.

By carrying out the press-forming method, the tool strain amount $\delta u_i$ [mm] can be always controlled to correspond to the tool strain amount target value $\delta ut_i$ [mm] even when various forming conditions change, and therefore, variation in the formed product quality caused by the tool strain amount $\delta u_i$ [mm] differing at each forming can be reduced.

Example 1

As the example 1 of the present invention, the press-forming device shown in FIG. 7 was made on an experimental basis, and press-forming was performed. The characteristics of the steel plate which was used are shown in Table 1. The ordinary steel in the range of a plate thickness of 1.0 mm with a Young's modulus of 270 MPa was used.

TABLE 1

| MATERIAL | YIELD STRESS [MPa] | TENSILE STRENGTH [MPa] | PERCENTAGE ELONGATION [%] |
|---|---|---|---|
| ORDINARY STEEL | 192 | 308 | 49 |

Figure 15:
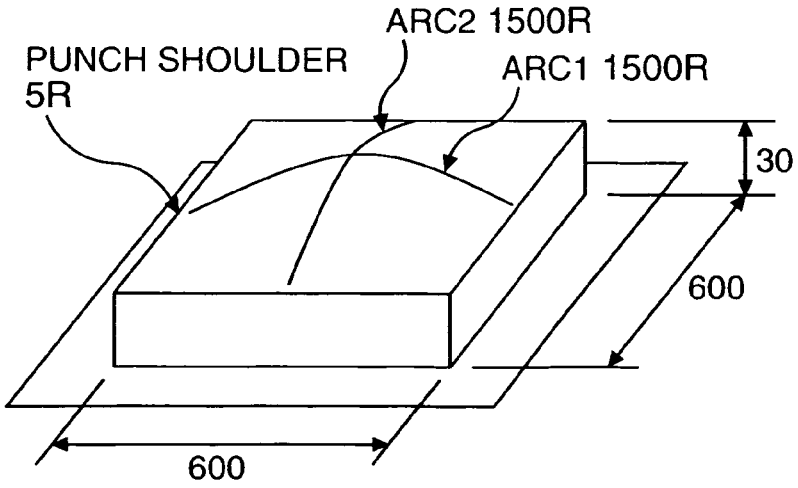
FIG. 15 is a general view of a formed product in forming of a square pillar member.
Figure 16:
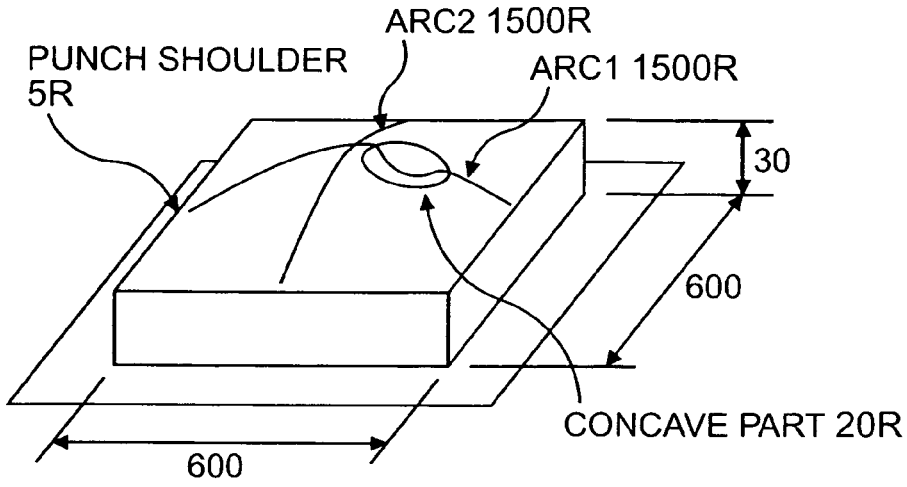
FIG. 16 is a general view of another formed product in forming of a square pillar member.

A formed member 1 is shown in FIG. 15, and a formed member 2 is shown in FIG. 16. The formed member 1 is a square pillar member 600 mm by 600 mm by forming height of 30 mm with a punch bottom surface having a radius of curvature of 1500 mm (1500 R) and a punch shoulder of R5 mm as shown in FIG. 15.

The formed member 2 is a square pillar member 600 mm by 600 mm by a forming height of 30 mm with a punch bottom surface having a radius of curvature of 1500 mm (1500 R), the punch bottom surface having a recessed shape of a radius of curvature of 20 mm (20 R), and a punch shoulder of R5 mm as shown in FIG. 16.

Figure 17:
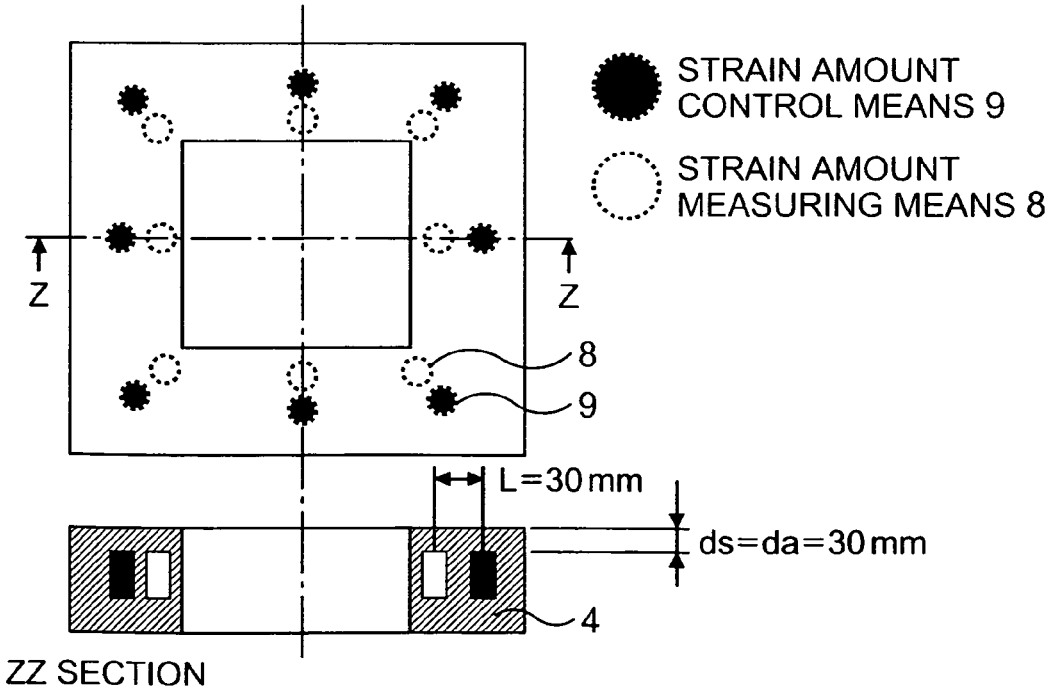
FIG. 17 is a view showing an installation method of the strain amount measuring means and the strain amount control means.

In this forming, the blank holder 4 was selected as the member to be controlled. FIG. 17 shows the blank holder 4 used in the forming. As shown in FIG. 17, eight of the strain amount measuring means 8 and eight of the strain amount control means 9 were installed. The strain amount measuring means 8 was installed inside the tool so that the strain amount measuring position was at ds=30 mm from the tool surface by using the method of boring a drill hole which does not penetrate through in the tool and cutting a female thread screw, putting the strain amount measuring means 8 onto the bottom of the drill hole and press-fitting it by applying axial force with a plug as shown in FIGS. 2A to 2C.

Further, the strain amount control means 9 was also installed so that the strain amount control position is at da=30 mm from the tool surface by using the method of boring a drill hole which does not penetrate through in the tool and cutting a female thread screw, putting the strain amount control means 9 onto the bottom of the drill hole, and press-fitting it by applying an axial force with a plug. The strain amount control means 9 was installed so that the distance between the strain amount measuring position and the strain amount control position was L=30 mm.

Figure 18:
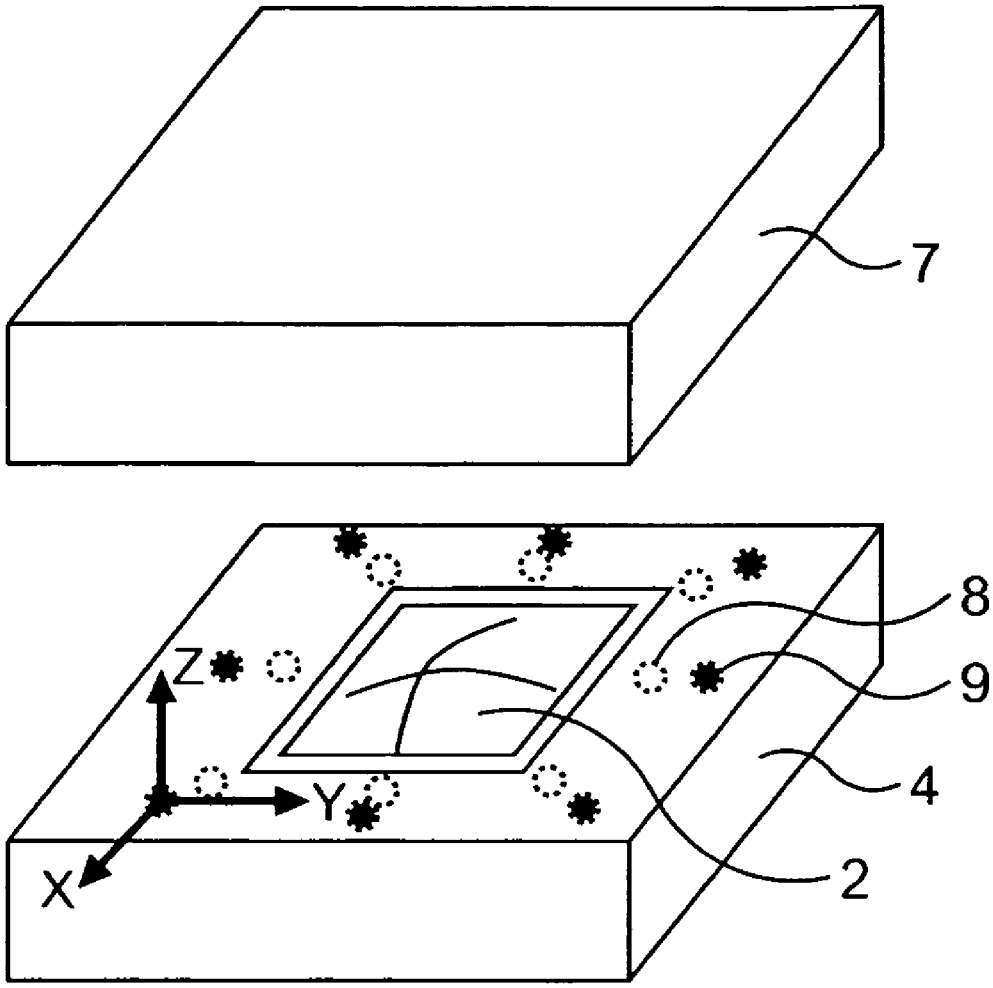
FIG. 18 is a view showing an installation direction of the strain amount measuring means and the strain amount control means.

FIG. 18 shows the installation directions of the strain amount measuring means 8 and the strain amount control means 9. First, in order to define the installation directions, the XYZ orthogonal coordinate system as shown in FIG. 18 was defined. In this case, X represents the formed product longitudinal direction, Y represents the formed product width direction, and Z represents the tool product height direction.

All the eight strain amount measuring means 8 were installed so that the strain amount measuring directions were expressed by the vectors with the components satisfying (X, Y, Z)=(0, 0, 1) in the above described orthogonal coordinate system with the strain amount measuring position as the origin. In the forming, as the strain amount measuring means 8, the piezoelectric sensor capable of detecting the compression and stretching strain in the strain amount measuring direction was used. Thereby, the strain measuring means 8 can detect the compression and stretching strain in the Z-axis direction.

All the eight strain amount control means 9 were installed so that the strain amount control directions were expressed by the vectors with the components satisfying (X, Y, Z)=(0, 0, 1) in the above described orthogonal coordinate system with the strain amount control position as the origin.

In the forming, as the strain amount control means 9, the piezoelectric actuator capable of controlling the compression and stretching strain in the strain amount control direction was used. Thereby, the strain amount control means 9 can control the compression and stretching strain in the Z-axis direction.

In the forming, for each i, $\delta S_i$=1 [mm] was set. Namely, the measurement and control loop was repeatedly executed for each stroke of 1 mm. In the forming, for each i, the tool strain amount target value was set at $\delta ut_i$=0 [mm]. Further, the formula of step S106 of the flow chart shown in FIG. 9 was $$\delta uc_{i+1}=\delta uc_i+f(\delta u_i-\delta ut_i)=\delta uc_i-(\delta u_i-\delta ut_i).$$

Therefore, the tool deflection control amount $\delta uc_{i+1}$ [mm] was determined according to $\delta uc_{i+1}=\delta uc_i-(\delta u_i-\delta ut_i)=\delta uc_i-\delta u_i$.

Namely, in the forming, the strain amount control means 9 performed control to make the tool strain amount $\delta u_i$ [mm] which was detected by the strain amount measuring means 8 close to zero.

Further, as a comparative example 1, forming without using the press-forming device of the present invention was performed. The forming conditions in the press-forming device used for the comparative example 1 were the same as those in the example 1 except that the comparative example 1 did not use the strain amount measuring means 8 and the strain amount control means 9 of the present invention.

Comparison of the profile irregularity and shape fixability in the example 1 of the present invention and the comparative example 1 is shown in Table 2. First, the bottom surfaces of the two formed products that are the formed member 1 and the formed member 2 were measured with the three-dimensional shape measuring device, and forming curvatures (k=1/R) were calculated along an arc 1 and arc 2 of FIG. 15 or FIG. 16. Here, R is a radius of curvature.

Next, a maximum value Δk of the difference between the measured forming curvature k and the forming curvature $k_{design}$ of the tool was calculated. If the formed product has the same forming curvature distribution as the tool ($k=k_{design}$), Δk=0. The Δk was made the index of the profile irregularity and shape fixability.

TABLE 2

| | | Δk (ARC 1)[1/m] | Δk (ARC 2)[1/m] |
|---|---|---|---|
| EXAMPLE 1 | FORMED MEMBER 1 | 2.1 | 1.9 |
| | FORMED MEMBER 2 | 3.2 | 3.8 |
| COMPARATIVE EXAMPLE 1 | FORMED MEMBER 1 | 12.5 | 14.2 |
| | FORMED MEMBER 2 | 13.5 | 13.1 |

As shown in Table 2, more favorable results were obtained from the formed member 1 and the formed member 2 in the example 1 of the present invention with respect to the profile irregularity and shape fixability. It is conceivable that reduction in the surface strain and improvement in shape fixability of the press-formed product was achieved by carrying out the present invention.

Example 2

As an example 2 of the present invention, the press-forming device shown in FIG. 7 was made on an experimental basis, and press-forming was performed. In order to study the forming limit improving effect according to the present invention, forming was performed by changing the forming height of 30 mm of the formed member 1 and the formed member 2 in the example 1. The conditions except for the forming height were the same as those in the example 1.

Further, as a comparative example 2, forming without using the press-forming device of the present invention was performed. The forming conditions in the press-forming device used for the comparative example 2 were the same as those in the example 2 except that the comparative example 2 did not use the strain amount measuring means 8 and the strain amount control means 9 of the present invention.

Table 3 shows the comparison of the forming limits in the example 2 of the present invention and the comparative example 2. Forming was performed with the number of samples being 30, the case where 90% or more of them were formed without breakage is marked with a circle (good), the case where 50% to 90% of them were able to be formed without breakage is marked with a triangle (fair), and the case where not more than 50% of them were able to be formed without breakage is marked with a cross (poor).

TABLE 3

| | | FORMING HEIGHT 30 mm | FORMING HEIGHT 35 mm | FORMING HEIGHT 40 mm |
|---|---|---|---|---|
| EXAMPLE 2 | FORMED MEMBER 1 | ○ | ○ | ○ |
| | FORMED MEMBER 2 | ○ | ○ | Δ |
| COMPARATIVE EXAMPLE 2 | FORMED MEMBER 1 | ○ | x | x |
| | FORMED MEMBER 2 | Δ | x | x |

As shown in Table 3, more favorable results were obtained from the formed member 1 and the formed member 2 of the example 2 of the present invention with respect to the forming limit. It is conceivable that improvement in the forming limit of the press-formed products was achieved by carrying out the present invention.

Example 3

As an example 3 of the present invention, the press-forming device shown in FIG. 7 was made on an experimental basis, and press-forming was performed. In order to study the effect of reducing the formed product quality variation according to the present invention, the formed members 1 and the formed members 2 in the example 1 were produced in volume. Each of the production amounts of the square pillar member and the hat section member was 100 per day×30 days, that is, 3000 in total. The production period was six months. The various forming conditions were set as the same as those in the example 1.

Further, as a comparative example 3, forming without using the press-forming device of the present invention was performed. The forming conditions in the press-forming device used for the comparative example 3 were the same as those in the example 3 except that the comparative example 3 did not use the strain amount measuring means 8 and the strain amount control means 9 of the present invention.

Table 4 shows the comparison of the formed product quality variations in the example 3 of the present invention and the comparative example 3. As the assessment indexes of the formed product quality variation of the formed members, the following two were used.

(1) Crack and wrinkle occurrence rate=number of crack and wrinkle occurrences/number of products produced in total (2) Δk variation=standard deviation of Δk/average value of Δk Calculation of the Δk variation was performed for the members which were able to be formed without cracks or wrinkles.

TABLE 4

| | | CRACK and WRINKLE OCCURRENCE RATE | Δk VARIATION (ARC 1) | Δk VARIATION (ARC 2) |
|---|---|---|---|---|
| EXAMPLE 3 | FORMED MEMBER 1 | 0.3% | 2.1% | 1.9% |
| | FORMED MEMBER 2 | 1.2% | 3.6% | 4.1% |
| COMPARATIVE EXAMPLE 3 | FORMED MEMBER 1 | 8.2% | 18.2% | 17.6% |
| | FORMED MEMBER 2 | 14.5% | 22.1% | 19.6% |

As shown in Table 4, more favorable results were obtained from the formed member 1 and the formed member 2 of the example 3 of the present invention. It is conceivable that in the example 3 of the present invention, control was performed so that the tool strain amount $\delta u_i$ [mm] always corresponds to the tool strain amount target value $\delta ut_i$ [mm] even when various forming conditions changed, and therefore, variation in the formed product quality was reduced.

Example 4

As an example 4 of the present invention, the press-forming device shown in FIG. 7 was made on an experimental basis, and press-forming was performed. The characteristics of the steel plate which was used were the same as Table 1. The formed members were two that are the formed member 1 shown in FIG. 15 and the formed member 2 shown in FIG. 16.

Figure 19:
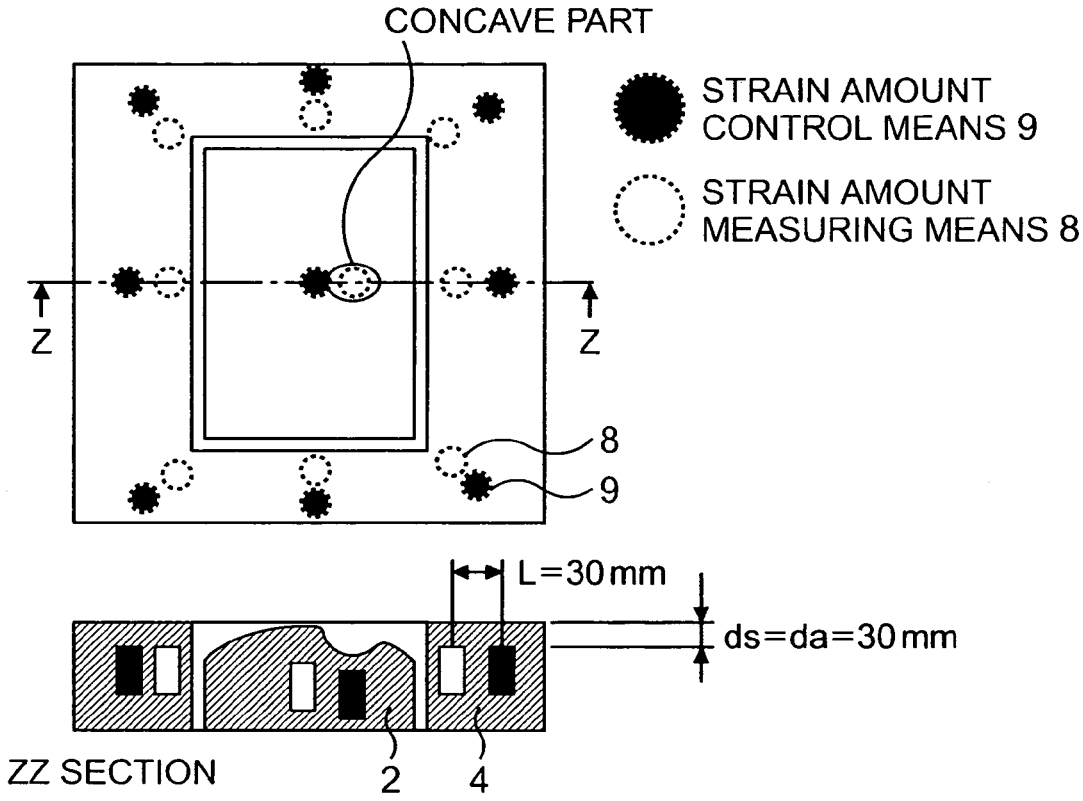
FIG. 19 is a view showing an installation method of the strain amount measuring means and the strain amount control means.

In the forming, as the members to be controlled, the punch 2, the blank holder 4 and the die 7 were selected. FIG. 19 shows the punch 2 and the blank holder 4 used for the forming. As shown in the drawing, in the blank holder 4, eight of the strain amount measuring means 8 and eight of the strain amount control means 9 are installed. Further, as the installation method of the strain amount measuring means 8 and the strain amount control means 9, the method of boring a drill hole which does not penetrate through in the tool, cutting a female thread screw, putting the strain amount measuring means 8 onto the bottom of the drill hole, and applying an axial force with a plug to press-fit the strain amount measuring means 8 was used as in FIGS. 2A to 2C.

The strain amount measuring means 8 was installed so that its strain amount measuring position was at ds=30 mm from the surface of the blank holder 4. Further, the strain amount control means 9 was installed so that the strain amount control position was at da=30 mm from the surface of the blank holder 4. Further, the strain amount control means 9 was installed so that the distance between the strain amount measuring position and the strain amount control position was L=30 mm.

Figure 20:
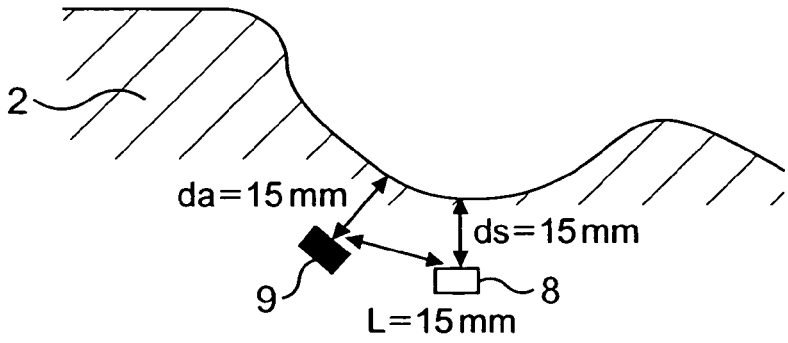
FIG. 20 is a view showing an installation method of the strain amount measuring means and the strain amount control means to the punch.

Further, in the punch 2, one strain amount measuring means 8 and one strain amount control means 9 are installed. The installation method of the strain amount measuring means 8 and the strain amount control means 9 into the punch 2 is shown in FIG. 20.

The strain amount measuring means 8 was installed so that the strain amount measuring position was at ds=15 mm from the surface of the punch 2. Further, the strain amount control means 9 was installed so that the strain amount control position was at da=15 mm from the surface of the punch 2. Further, the strain amount control means 9 was installed so that the distance between the strain amount measuring position and the strain amount control position was L=15 mm.

Figure 21:
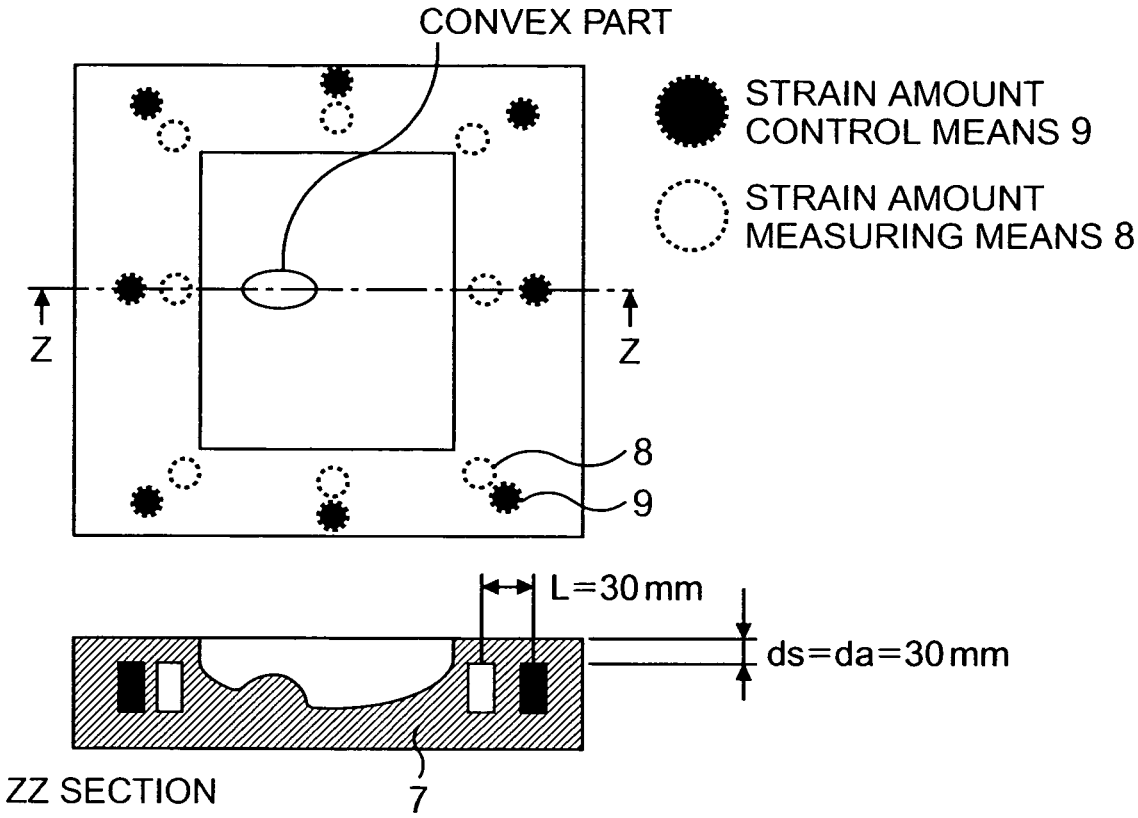
FIG. 21 is a view showing an installation method of the strain amount measuring means and the strain amount control means.

FIG. 21 shows the die 7 used for the forming. As shown in the drawing, eight of the strain amount measuring means 8 and eight of the strain amount control means 9 were installed in the die 7. Further, as the installation method of the strain amount measuring means 8 and the strain amount control means 9, the method of boring a drill hole which does not penetrate through in the tool, cutting a female thread screw, putting the strain amount measuring means 8 onto the bottom of the drill hole, and applying an axial force with a plug to press-fit the strain amount measuring means 8 was used as in FIGS. 2A to 2C.

The strain amount measuring means 8 was installed so that the strain amount measuring position was at ds=30 mm from the surface of the die 7. Further, the strain amount control means 9 was installed so that the strain amount control position was at da=30 mm from the surface of the die 7. Further, the strain amount control means 9 was installed so that the distance between the strain amount measuring position and the strain amount control position was L=30 mm.

Figure 22:
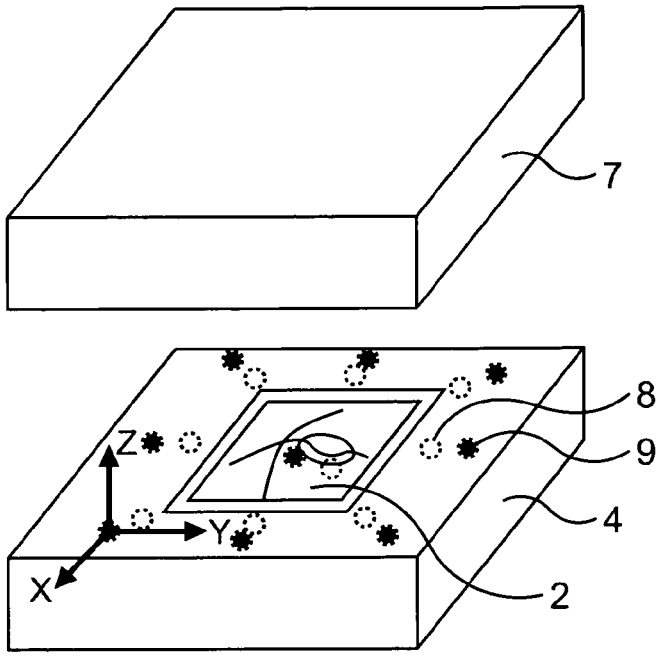
FIG. 22 is a view showing an installation direction of the strain amount measuring means and the strain amount control means.

FIG. 22 shows the installation directions of the strain amount measuring means 8 and the strain amount control means 9. First, in order to define the installation directions, the XYZ orthogonal coordinate system as shown in the drawing was defined. In this case, X represents the formed product longitudinal direction, Y represents the formed product width direction, and Z represents the formed product height direction.

In the blank holder 4 and the die 7, all the eight strain amount measuring means 8 were installed so that the strain amount measuring directions were expressed by the vectors with their components satisfying (X, Y, Z)=(0, 0, 1) in the above described orthogonal coordinate system with the strain amount measuring position as the origin. In the forming, as the strain amount measuring means 8, a piezoelectric sensor capable of detecting the compression and stretching strain in the strain amount measuring direction was used. Thereby, the strain amount measuring means 8 is capable of detecting the compression and stretching strain in the Z-axis direction.

In the blank holder 4 and the die 7, all the eight strain amount control means 9 were installed so that their strain amount control directions were expressed by the vectors with their components satisfying (X, Y, Z)=(0, 0, 1) in the above described orthogonal coordinate system with the strain amount control position as the origin. In the forming, as the strain amount control means 9, a piezoelectric actuator capable of controlling the compression and stretching strain in the strain amount measuring direction was used. Thereby, the strain amount control means 9 is capable of controlling the compression and stretching strain in the Z-axis direction.

In the punch 2, the strain amount measuring means 8 was installed so that the strain amount measuring direction was expressed by the vector with its components satisfying (X, Y, Z)=(0, 0, 1) in the above described orthogonal coordinate system with the strain amount measuring position as the origin. In the forming, as the strain amount measuring means 8, a piezoelectric sensor capable of detecting the compression and stretching strain in the strain amount measuring direction was used.

In the punch 2, the strain amount control means 9 was installed so that its strain amount control direction was expressed by the vector with its components satisfying (X, Y, Z)=(0, 1/√2, 1/√2) in the above described orthogonal coordinate system with the strain amount control position as the origin. In the forming, as the strain amount control means 9, a piezoelectric actuator capable of controlling the compression and stretching strain in the strain amount control direction was used.

In the forming, $\delta S_i$=1 [mm] was set for each i. Namely, measurement and control loop was repeatedly carried out at every stroke of 1 mm. In the forming, the tool strain amount target value $\delta ut_i$=0 [mm] was set for each i. The formula of step S106 of the flow chart shown in FIG. 8 was $$\delta uc_{i+1}=\delta uc_i+f(\delta u_i-\delta ut_i)=\delta uc_i-(\delta u_i-\delta ut_i)$$

Therefore, the tool deflection control amount $\delta uc_{i+1}$ [mm] was determined from $\delta uc_{i+1}=\delta uc_i-(\delta u_i-\delta ut_i)=\delta uc_i-\delta u_i$.

Namely, in the forming, the strain amount control means 9 performed control so that the tool strain amount $\delta u_i$ [mm] which was detected by the strain amount measuring means 8 was made close to zero.

Further, as a comparative example 4, forming without using the press-forming device of the present invention was performed. The forming conditions in the press-forming device used for the comparative example 4 were set as the same as those in the example 4 except that the comparative example 4 did not use the strain amount measuring means 8 and the strain amount control means 9 of the present invention.

Comparison of the profile irregularity and shape fixability in the example 4 of the present invention and the comparative example 4 is shown in Table 5. First, the bottom surfaces of the two formed products that are the formed member 1 and the formed member 2 were measured with the three-dimensional shape measuring device, and forming curvatures (k=1/R) were calculated along the arc 1 and the arc 2 of FIG. 15 or FIG. 16. Here, R is a radius of curvature.

Next, the maximum value Δk of the difference between the measured forming curvature k and the forming curvature $k_{design}$ of the tool was calculated. If the formed product has the same forming curvature distribution as the tool ($k=k_{design}$), Δk=0. The Δk was made the index of the profile irregularity and shape fixability.

TABLE 5

| | | Δk (ARC 1)[1/m] | Δk (ARC 2)[1/m] |
|---|---|---|---|
| EXAMPLE 4 | FORMED MEMBER 1 | 1.8 | 1.5 |
| | FORMED MEMBER 2 | 3.3 | 2.7 |
| COMPARATIVE EXAMPLE 4 | FORMED MEMBER 1 | 11.2 | 12.1 |
| | FORMED MEMBER 2 | 12.9 | 11.5 |

As shown in Table 5, more favorable results were obtained from the formed member 1 and the formed member 2 of the example 4 of the present invention with respect to the profile irregularity and shape fixability. It is conceivable that reduction in the surface strain and improvement in shape fixability of the press-formed product was achieved by carrying out the present invention.

Example 5

As an example 5 of the present invention, the press-forming device shown in FIG. 7 was made on an experimental basis, and press-forming was performed. In order to study the forming limit improving effect according to the present invention, forming was performed by changing the forming height of 30 mm of the formed member 1 and the formed member 2 in the example 4. The conditions except for the forming height were the same as those in the example 4.

Further, as a comparative example 5, forming without using the press-forming device of the present invention was performed. The forming conditions in the press-forming device used for the comparative example 5 were the same as those in the example 5 except that the comparative example 5 did not use the strain amount measuring means 8 and the strain amount control means 9 of the present invention.

Table 6 shows the comparison of the forming limits in the example 5 of the present invention and the comparative example 5. Forming was performed with the number of samples being 30, the case where 90% or more of them were formed without breakage is marked with a circle (good), the case where the samples from 50% to 90% were able to be formed without breakage is marked with a triangle (fair), and the case where not more than 50% of them were able to be formed without breakage is marked with a cross (poor).

TABLE 6

| | | FORMING HEIGHT 30 mm | FORMING HEIGHT 35 mm | FORMING HEIGHT 40 mm |
|---|---|---|---|---|
| EXAMPLE 5 | FORMED MEMBER 1 | ○ | ○ | ○ |
| | FORMED MEMBER 2 | ○ | ○ | ○ |
| COMPARATIVE EXAMPLE 5 | FORMED MEMBER 1 | ○ | x | x |
| | FORMED MEMBER 2 | Δ | x | x |

As shown in Table 6, more favorable results were obtained from the formed member 1 and the formed member 2 of the example 5 of the present invention with respect to the forming limit. It is conceivable that improvement in the forming limit of the press-formed products was achieved by carrying out the present invention.

Example 6

As an example 6 of the present invention, the press-forming device shown in FIG. 7 was made on an experimental basis, and press-forming was performed. In order to study the effect of reducing the formed product quality variation according to the present invention, the formed member 1 and the formed member 2 in the example 4 were produced in volume. The production amount of each of the square pillar member and the hat section member was 100 per day×30 days, that is, 3000 in total. The production period was six months. The various forming conditions were the same as those in the example 4.

Further, as a comparative example 6, forming without using the press-forming device of the present invention was performed. The forming conditions in the press-forming device used for the comparative example 6 were set as the same as those in the example 6 except that the comparative example 6 did not use the strain amount measuring means 8 and the strain amount control means 9 of the present invention.

Table 7 shows the comparison of the formed product quality variations in the example 6 of the present invention and the comparative example 6. As the assessment indexes of the formed product quality variation of the formed members, the following two were used.

(1) Crack and wrinkle occurrence rate=number of crack and wrinkle occurrences/number of products in total (2) Δk variation=standard deviation of Δk/average value of Δk Calculation of the Δk variation was performed for the members that were able to be formed without cracks or wrinkles.

TABLE 7

| | | CRACK and WRINKLE OCCURRENCE RATE | Δk VARIATION (ARC 1) | ΔK VARIATION (ARC 2) |
|---|---|---|---|---|
| EXAMPLE 6 | FORMED MEMBER 1 | 0.1% | 1.2% | 1.1% |
| | FORMED MEMBER 2 | 0.9% | 3.3% | 4.0% |
| COMPARATIVE EXAMPLE 6 | FORMED MEMBER 1 | 7.9% | 17.5% | 17.2% |
| | FORMED MEMBER 2 | 15.5% | 23.1% | 19.4% |

As shown in Table 7, more favorable results were obtained from both the formed member 1 and the formed member 2 in the example 6 of the present invention. It is conceivable that in the example 6 of the present invention, control was performed so that the tool strain amount $\delta u_t$ [mm] always corresponded to the tool strain amount target value $\delta ut_t$ [mm] even when various forming conditions changed, and therefore, variation in the formed product quality was reduced.

Example 7

As an example 7 of the present invention, the press-forming device shown in FIG. 9 was made on an experimental basis, and press-forming was performed. The characteristics of the steel plate which was used were the same as shown in Table 1. As the formed product, the formed member 1 shown in FIG. 15 was formed. The installation method of the strain amount measuring means 8 and the strain amount control means 9 is the same as in the example 1.

The frictional force calculating means 11 calculated the frictional force based on the following arithmetic expression.

$$F_{fric}=(3\times10^{-3})\times\text{Strain }(s)\times\text{BHF}$$

$F_{fric}$: frictional force [N] occurring at the time of sliding

Strain (s): the average value of the strain amount outputted from the eight strain amount measuring means in the stroke position S=dr+dp+t (dr: die shoulder R, dp: punch shoulder R, t: plate thickness of the material to be worked)

BHF: blank holding force [N]

The example 7 of the present invention conducted the control to generate a strain of 50με by the strain amount control means 9 when the output of the frictional force calculating means 11 is 100 kN or less, and to generate a strain of 20με by the strain amount control means 9 when the output of the frictional force calculating means 11 is 100 kN or more.

Further, as a comparative example 7, forming without using the press-forming device of the present invention was performed. The forming conditions in the press-forming device used for the comparative example 7 were the same as those in the example 7 except that the comparative example 7 did not use the strain amount measuring means 8 and the strain amount control means 9 of the present invention.

Comparison of the profile irregularity and shape fixability in the example 7 of the present invention and the comparative example 7 is shown in Table 8. The assessment method of the formed products is the same as the example 1.

TABLE 8

| | Δk (ARC 1)[1/m] | Δk (ARC 2)[1/m] |
|---|---|---|
| EXAMPLE 7 | 1.4 | 2.1 |
| COMPARATIVE EXAMPLE 7 | 12.5 | 14.2 |

As shown in Table 8, more favorable result was obtained from the example 7 of the present invention with respect to the profile irregularity and shape fixability. It is conceivable that reduction in the surface strain and improvement in shape fixability of the press-formed product was achieved by carrying out the present invention.

Example 8

As an example 8 of the present invention, the press-forming device shown in FIG. 12 was made on an experimental basis, and press-forming was performed. The characteristics of the steel plate which was used were the same as shown in Table 1. As the formed product, the formed member 1 shown in FIG. 15 was formed. The installation method of the strain amount measuring means 8 and the strain amount control means 9 is the same as in the example 1.

The frictional force calculating means 11 calculated the frictional force based on the following arithmetic expression.

$$F_{fric}=(3\times10^{-3})\times\text{Strain }(s)\times\text{BHF}$$

$F_{fric}$: frictional force [N] occurring at the time of sliding

Strain (s): the average value of the strain amount outputted from the eight strain amount measuring means in the stroke position S=dr+dp+t (dr: die shoulder R, dp: punch shoulder R, t: plate thickness of the material to be worked)

BHF: blank holding force [N]

Further, the first spring back amount calculating means 12 calculated the spring back amount based on the following arithmetic expression.

$$\Delta\theta_p=0.13F_{fric}-4.5$$

$\Delta\theta_p$: spring back amount of formed product punch shoulder angle [deg]

$F_{fric}$: frictional force [N] occurring at the time of sliding

The example 8 of the present invention conducted the control to generate a strain of 50με by the strain amount control means 9 when the output of the first spring back amount calculating means 12 is 8.5 degrees or less, and to generate a strain of 20με by the strain amount control means 9 when the output of the first spring back amount calculating means 12 is 8.5 degrees or more.

Further, as a comparative example 8, forming without using the press-forming device of the present invention was performed. The forming conditions in the press-forming device used for the comparative example 8 were the same as those in the example 8 except that the comparative example 8 did not use the strain amount measuring means 8 and the strain amount control means 9 of the present invention.

Comparison of the profile irregularity and shape fixability in the example 8 of the present invention and the comparative example 8 is shown in Table 9. The assessment method of the formed products is the same as the example 1.

TABLE 9

| | Δk (ARC 1)[1/m] | Δk (ARC 2)[1/m] |
|---|---|---|
| EXAMPLE 8 | 1.3 | 2.5 |
| COMPARATIVE EXAMPLE 8 | 12.5 | 14.2 |

As shown in Table 9, more favorable result was obtained from the example 8 of the present invention with respect to the profile irregularity and shape fixability. It is conceivable that reduction in surface strain and improvement in shape fixability of the press-formed product was achieved by carrying out the present invention.

Example 9

As an example 9 of the present invention, the press-forming device shown in FIG. 13 was made on an experimental basis, and press-forming was performed. The characteristics of the steel plate which was used were the same as shown in Table 1. As the formed product, the formed member 1 shown in FIG. 15 was formed. The installation method of the strain amount measuring means 8 and the strain amount control means 9 is the same as in the example 1.

The second spring back amount calculating means 13 calculated the spring back amount based on the following arithmetic expression.

$$\Delta\theta_p=0.15\text{ Strain }(s)-4.5$$

$\Delta\theta_p$: spring back amount of formed product punch shoulder angle [deg]

Strain (s): strain amount in the stroke position S=dr+dp+t (dr: die shoulder R, dp: punch shoulder R, t: plate thickness of the material to be worked)

The example 9 of the present invention conducted the control to generate a strain of 50με by the strain amount control means 9 when the output of the second spring back amount calculating means 13 was 8.5 degrees or less, and to generate a strain of 20με by the strain amount control means 9 when the output of the second spring back amount calculating means 13 was 8.5 degrees or more.

Further, as a comparative example 9, forming without using the press-forming device of the present invention was performed. The forming conditions in the press-forming device used for the comparative example 9 were the same as those in the example 9 except that the comparative example 9 did not use the strain amount measuring means 8 and the strain amount control means 9 of the present invention.

Comparison of the profile irregularity and shape fixability in the example 9 of the present invention and the comparative example 9 is shown in Table 10. The assessment method of the formed products is the same as the example 1.

TABLE 10

| | Δk (ARC 1)[1/m] | Δk (ARC 2)[1/m] |
|---|---|---|
| EXAMPLE 9 | 1.7 | 2.9 |
| COMPARATIVE EXAMPLE 9 | 12.5 | 14.2 |

As shown in Table 10, more favorable result was obtained from the example 9 of the present invention with respect to the profile irregularity and shape fixability. It is conceivable that reduction in surface strain and improvement in shape fixability of the press-formed product was achieved by carrying out the present invention.

Example 10

As an example 10 of the present invention, the press-forming device shown in FIG. 9 was made on an experimental basis, and press-forming was performed. The characteristics of the steel plate which was used were the same as shown in Table 1. As the formed product, the formed member 1 shown in FIG. 15 was formed. The installation method of the strain amount measuring means 8 and the strain amount control means 9 is the same as in the example 1. The frictional force calculating method by the frictional force calculating means 11 is the same as the method used in the example 7. In the example 10 of the present invention, strain amount control of the member to be controlled by using the strain amount control means 9 was not carried out.

Figure 23:
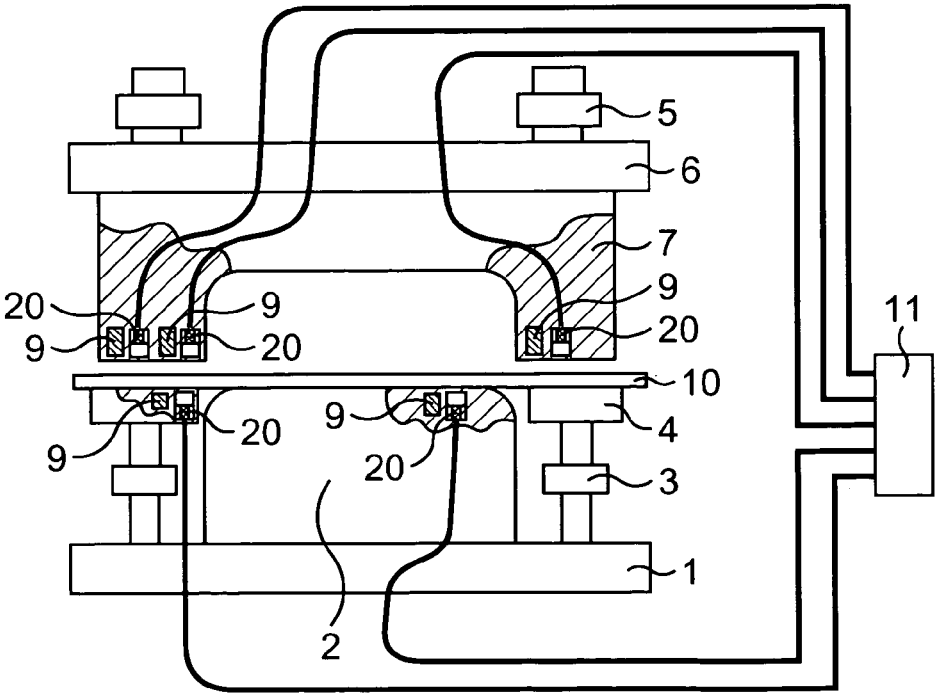
FIG. 23 is a schematic view of the press-forming device having the strain amount measuring means, the strain amount control means and the frictional force calculating means.
Figure 24:
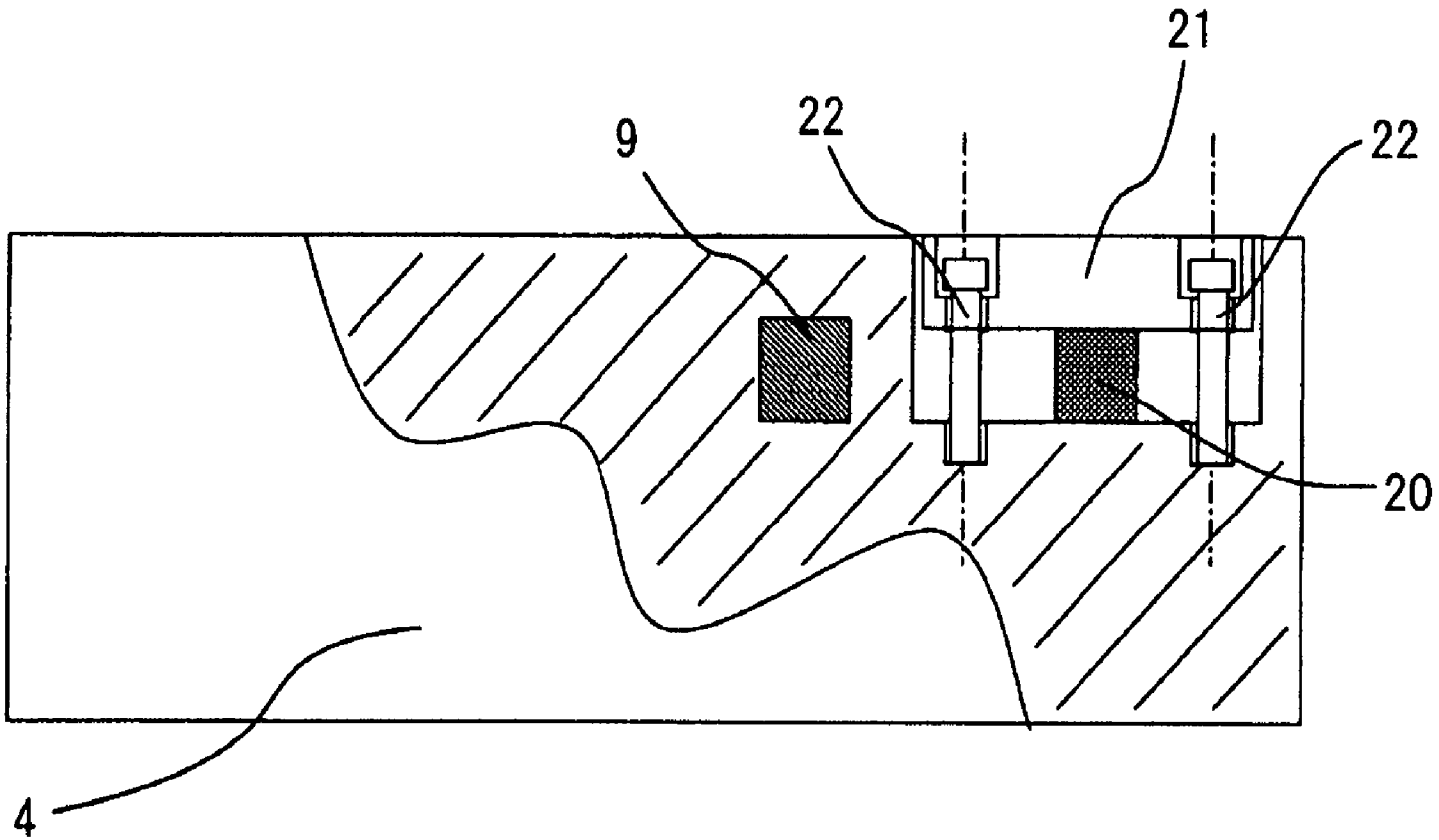
FIG. 24 is an enlarged view of the area in the vicinity of the mounting position of the strain amount measuring element.
Figure 25:
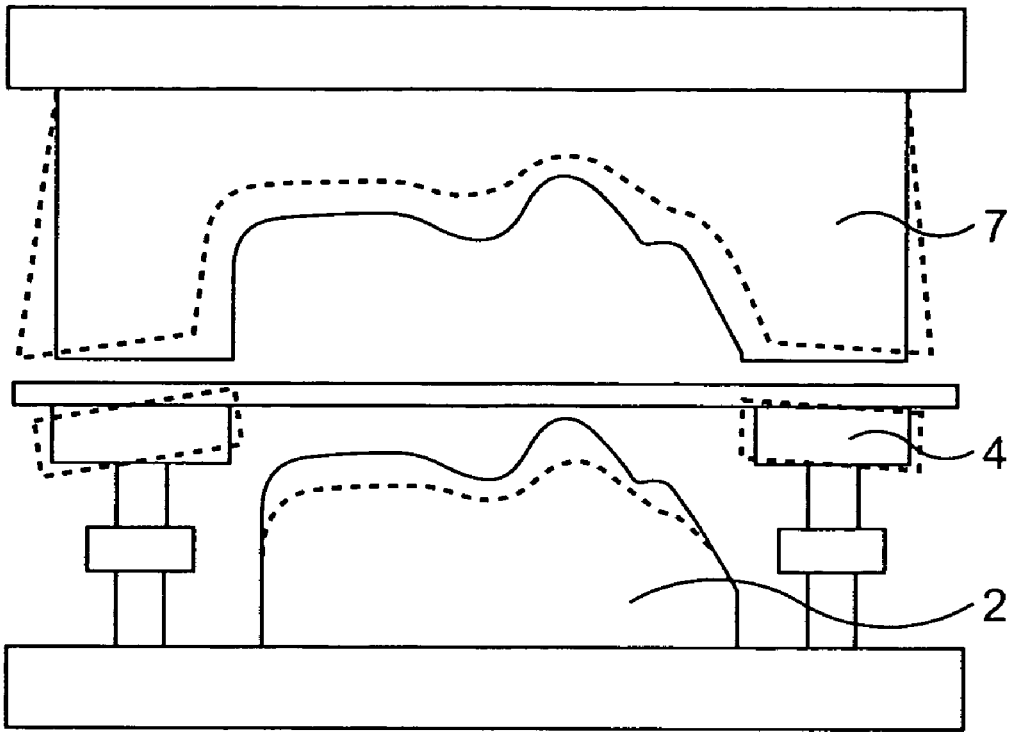
FIG. 25 is a conceptual view of a tool strain.

Further, as a comparative example 10, a press-forming device as shown in FIG. 23 was made on an experimental basis. In FIG. 23, as the substitute of the strain amount measuring means 8, a flat plate 21 and the blank holder 4, or the flat plate 21 and the die 7, or the flat plate 21 and the punch 2 were fastened with fastening bolts 22 so as to sandwich a strain amount measuring element 20. Press-forming was performed in this state, and a shearing strain of the strain amount measuring element 20 by slide of the steel plate and the above described flat plate was measured, whereby the frictional force was calculated. An enlarged view of the area in the vicinity of the mounting position of the strain amount measuring element 20 in FIG. 23 is shown in FIG. 24.

For calculation of the frictional force in the comparative example 10, the following arithmetic expression was used.

$$F_{fric}=(9\times10^{-3})\times\text{Strain }(s)\times\text{BHF}$$

$F_{fric}$: frictional force [N] occurring at the time of sliding

Strain (s): the average value of the strain amounts outputted from the eight strain amount measuring means in the stroke position S=dr+dp+t (dr: die shoulder R, dp: punch shoulder R, t: plate thickness of the material to be worked)

BHF: blank holding force [N]

The forming conditions in the press-forming device shown in FIG. 23 which was used for the comparative example 10 were the same conditions as the example 10 except that the structure as described above is installed as the substitute of the strain amount measuring means 8 of the present invention.

On press-forming, the frictional coefficient at the time of sliding was changed intentionally by using three kinds of oils that are a high-viscosity oil (200 cSt), an ordinary press oil (20 cSt) and a low-viscosity oil (5 cSt) as the press oil.

Table 11 shows comparison of the frictional coefficient calculation results in the example 10 of the present invention and the comparative example 10.

TABLE 11

| | HIGH-VISCOSITY OIL (200 cSt) | ORDINARY PRESS OIL (20 cSt) | LOW-VISCOSITY OIL (5 cSt) |
|---|---|---|---|
| EXAMPLE 10 | 1.29 | 1.51 | 1.85 |
| COMPARATIVE EXAMPLE 10 | 1.53 | 1.52 | 1.83 |

From the result of Table 11, when the low-viscosity oil and the ordinary press oil were used, a large difference was not seen in the example 10 of the present invention and the comparative example 10. In this case, it is understood that both of the example 10 of the present invention and the comparative example 10 can measure the frictional coefficient change due to difference in lubricating oil.

However, when the high-viscosity oil was used, a large difference was seen between the example 10 of the present invention and the comparative example 10.

While in the example 10 of the present invention, the frictional coefficient change due to difference in the lubricating oil of the high-viscosity oil and the ordinary press oil was able to be measured, the frictional coefficient change was not be able to be measured in the comparative example 10.

In the comparative example 10, as the substitute of the strain amount measuring means 8, the flat plate 21 and the blank holder 4, or the flat plate 21 and the die 7, or the flat plate 21 and the punch 2 were fastened by the fastening bolts 22 so as to sandwich the strain amount measuring element 20. However, the fastening bolt 22 has a backlash in the shearing direction. When a frictional force in a very small load range is measured by shearing strain measurement of the strain amount measuring element 20, the influence of the backlash in the shearing direction of the fastening bolt 22 is serious, and measurement is difficult.

The method for measuring a frictional force by installing some structure on the outside of the blank holding die 4 and the die 7 as in the comparative example 10 does not directly measure the tool strains of the blank holder 4 and the die 7. The measurement result equivalent to the tool strains of the blank holder 4 and the die 7 cannot be sometimes obtained due to the influence of the backlash of the fastening bolt 22 and the like as in the comparative example 10.

On the other hand, in the example 10 of the present invention, the strain amount measuring means 8 was press-fitted by applying the axial force when the strain amount measuring means 8 was installed, whereby, the backlash does not become a problem as in the comparative example 10, and the tool strains of the blank holder 4 and the die 7 can be directly measured. Namely, the situation where the measurement result equivalent to the tool strains of the blank holder 4 and the die 7 cannot be obtained due to the influence of the backlash of the fastening bolt 22 or the like does not occur as in the comparative example 10.

From the above, it is conceivable that measurement of the frictional coefficient with high accuracy is possible by carrying out the present invention.

INDUSTRIAL APPLICABILITY

As described above, according to the present invention, the press-forming device and the press-forming method which are capable of controlling a tool strain at the time of press forming, and have high accuracy and high applicability can be provided.

What is claimed is:

1. A press-forming device, comprising:

a punch;

a die which relatively moves with respect to said punch;

a strain amount measuring unit which is provided inside a member to be controlled, and measures a strain amount of said member to be controlled which occurs in accordance with press-forming, When at least any one of said punch and said die is said member to be controlled;

a strain amount controller which is provided in said member to be controlled and controls a strain amount of said member to be controlled which occurs in accordance with press-forming, wherein the strain amount measuring unit and the strain amount controller are disposed next to each other inside said member to be controlled, and the distance between the strain amount measuring unit and the strain amount controller is 1 to 1000 mm, wherein the strain amount controller generates a strain in the direction to cancel off a compression strain amount and a stretching strain amount measured by the strain amount measuring unit.

2. The press-forming device according to claim 1, wherein said strain amount controller controls a drive amount of said member to be controlled so that the strain amount measured by said strain amount measuring unit is in a predetermined range during forming.

3. The press-forming device according to claim 1, further comprising:

a frictional force calculator which calculates a frictional force which occurs at a time of sliding of said member to be controlled and said material to be worked based on the strain amount measured by said strain amount measuring unit.

4. The press-forming device according to claim 3, further comprising:

a first spring hack amount calculator which calculates a spring back amount of a formed product shape based on the frictional force calculated by said frictional force calculator.

5. The press-forming device according to claim 1, further comprising:

a spring hack amount calculator which calculates a spring hack amount of a formed product shape based on the strain amount measured by said strain amount measuring unit.

6. The press-forming device according to claim 1, wherein said strain amount measuring unit is a piezoelectric sensor.

7. The press-forming device according, to claim 1, wherein said strain amount controller is a piezoelectric actuator.

8. A press-forming method using the press-forming device according to claim 1, wherein a drive amount of said member to be controlled by said strain amount controller is controlled so that the strain amount measured by said strain amount measuring unit is in a predetermined range during forming.

9. A press-forming device, comprising:

a punch;

a die which relatively moves with respect to said punch;

a blank holder which applies a plank holding force to a material to be worked;

a strain amount measuring unit which is provided inside a member to be controlled, and measures a strain amount of said member to be controlled which occurs in accordance with press-forming, when at least any one of said punch, said die and said blank holder is said member to be controlled;

a strain amount controller which is provided in said member to be controlled and controls a strain amount of said member to be controlled which occurs in accordance with press-forming, wherein the strain amount measuring unit and the strain amount controller are disposed next to each other inside said member to be controlled, and the distance between the strain amount measuring unit and the strain amount controller is 1 to 1000 mm, wherein the strain amount controller generates a strain in the direction to cancel of a compression strain amount and a stretching strain amount measured by the strain amount measuring unit.

10. The press-forming device according to claim 9, wherein said strain amount controller controls a drive amount of said, member to be controlled so that the strain amount measured by said strain amount measuring unit is in a predetermined range during forming.

11. The press-forming device according to claim 9, further comprising:

a frictional force calculator which calculates a frictional force which occurs at a time of sliding of said member to be controlled and said material to be worked based on the strain amount measured by said strain amount measuring unit.

12. The press-forming device according to claim 11, further comprising:

a first spring back amount calculator which calculates a spring back amount of a formed product shape based on the frictional three calculated by said frictional force calculator.

13. The press-forming device according to 9, further comprising:

a spring back amount calculator which calculates a spring back amount of a formed product shape based on the strain amount measured by said strain amount measuring unit.

14. The press-forming device according to 9, wherein said strain amount measuring unit is a piezoelectric sensor.

15. The press-forming device according to claim 9, wherein said strain amount controller is a piezoelectric actuator.

16. A press-forming method using the press-forming device according to claim 9, wherein a drive amount of said member to be controlled by said strain amount controller is controlled so that the strain amount measured by said strain amount measuring unit is in a predetermined range during forming.

* * * * *